US008254806B2

(12) United States Patent
Kato

(10) Patent No.: US 8,254,806 B2
(45) Date of Patent: Aug. 28, 2012

(54) PROCESS CARTRIDGE AND IMAGE FORMING APPARATUS

(75) Inventor: Shuichi Kato, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 384 days.

(21) Appl. No.: 12/555,982

(22) Filed: Sep. 9, 2009

(65) Prior Publication Data

US 2010/0061760 A1 Mar. 11, 2010

(30) Foreign Application Priority Data

Sep. 9, 2008 (JP) ..... 2008-231095

(51) Int. Cl.
*G03G 21/16* (2006.01)

(52) U.S. Cl. ..... 399/111; 399/110; 399/114; 399/119; 399/120; 399/262

(58) Field of Classification Search ..... 399/110, 399/111, 114, 116, 119, 120, 262
See application file for complete search history.

(56) References Cited

U.S. PATENT DOCUMENTS

| | | | | |
|---|---|---|---|---|
| 4,462,677 | A * | 7/1984 | Onoda | 399/114 |
| 5,937,242 | A * | 8/1999 | Yokoyama et al. | 399/114 |
| 5,950,049 | A * | 9/1999 | Yokomori et al. | 399/119 |
| 6,032,002 | A * | 2/2000 | Yokomori et al. | 399/12 |
| 6,078,764 | A * | 6/2000 | Akutsu | 399/114 |
| 6,144,821 | A * | 11/2000 | Oguma | 399/114 |
| 6,345,164 | B1 * | 2/2002 | Yokomori et al. | 399/119 |
| 6,560,425 | B1 * | 5/2003 | Lui et al. | 399/114 |
| 6,983,114 | B2 * | 1/2006 | Arimitsu | 399/114 |
| 6,990,302 | B2 * | 1/2006 | Toba et al. | 399/114 |
| 7,072,603 | B2 * | 7/2006 | Tsuzuki et al. | 399/111 |
| 7,160,407 | B2 * | 1/2007 | Weiler | 156/94 |
| 7,283,766 | B2 * | 10/2007 | Arimitsu et al. | 399/111 |

(Continued)

FOREIGN PATENT DOCUMENTS

JP 01-267662 10/1989

(Continued)

OTHER PUBLICATIONS

Office action received for Japanese Patent Application 2008-231095 mailed Jun. 29, 2010.

*Primary Examiner* — David Gray
*Assistant Examiner* — Francis Gray
(74) *Attorney, Agent, or Firm* — Banner & Witcoff, Ltd.

(57) ABSTRACT

A process cartridge includes: a frame having an opening that is long in a predetermined direction; a photosensitive drum held in the frame, a portion of a surface of the photosensitive drum being opposite to the opening of the frame, the photosensitive drum extending along a longitudinal direction of the opening; and a protection member that has: a linear body portion extending in the longitudinal direction; and a support portion extending from an end of the linear body portion in a direction perpendicular to the longitudinal direction, wherein the support portion is supported on the frame so as to rotate about an axis that extends along the longitudinal direction, and the linear body portion is movable between a protecting position and a retreat position.

18 Claims, 14 Drawing Sheets

U.S. PATENT DOCUMENTS

| | | | | |
|---|---|---|---|---|
| 2002/0131790 | A1* | 9/2002 | Sato et al. | 399/111 |
| 2003/0185587 | A1* | 10/2003 | Kawai et al. | 399/111 |
| 2003/0223772 | A1* | 12/2003 | Kubota | 399/114 |
| 2008/0159781 | A1 | 7/2008 | Noguchi et al. | |
| 2009/0129812 | A1* | 5/2009 | Kawanami et al. | 399/111 |
| 2010/0054798 | A1* | 3/2010 | Sato | 399/111 |

FOREIGN PATENT DOCUMENTS

| | | | |
|---|---|---|---|
| JP | 2002091266 A | * | 3/2002 |
| JP | 2005-241896 | | 9/2005 |
| JP | 2005241896 A | * | 9/2005 |
| JP | 2008-009405 | | 1/2008 |
| JP | 2008-165027 | | 7/2008 |

* cited by examiner

PROCESS CARTRIDGE AND IMAGE FORMING APPARATUS

CROSS REFERENCE TO RELATED APPLICATION

The present application claims priority from Japanese Patent Application No. 2008-231095, which was filed on Sep. 9, 2008, the disclosure of which is herein incorporated by reference in its entirety.

TECHNICAL FIELD

The present invention relates to a process cartridge and an image forming apparatus including the process cartridge.

BACKGROUND

In electrophotographic laser printers, there is known a laser printer in which process cartridges each including a photosensitive drum and a developing cartridge are detachably installed in an apparatus main body.

As a laser printer like this, there is proposed a laser printer in which a drum cover for opening and closing an opening from which a photosensitive drum is exposed is provided on a housing of a process cartridge in order to protect the photosensitive drum.

According to the above described laser printer, the drum cover is formed into a plate element having an arc-like cross section and extending along a circumferential surface of the photosensitive drum and covers the whole area of a portion of the photosensitive drum which is exposed from the opening. A circumferential end portion of the drum cover is supported rotatably on a shaft provided on the housing. In such a state that the process cartridge is detached from the apparatus main body, the opening is closed by the drum cover. When the process cartridge is installed into the apparatus main body, by being interlocked with this operation, the drum cover is caused to rotate about the shaft, whereby the opening is opened. By this action, the circumferential surface of the photosensitive drum is exposed from the opening, thereby making it possible to transfer an electrostatic latent image formed on the photosensitive drum onto a transfer sheet.

SUMMARY

However, according to the above described laser printer, when the opening is opened in association with installation of the process cartridge into the apparatus main body, a free end portion (the other end portion that is opposed to one end portion that is supported rotatably on the shaft) of the drum cover moves while tracing a large arc-shaped locus relative to the housing. Because of this, a large space becomes necessary within the apparatus main body for opening and closing the drum cover in an opposite direction to the photosensitive drum.

Accordingly, it is an object of the invention to provide a process cartridge which can reduce a space required within an apparatus main body of an image forming apparatus for opening and closing a protection member and an image forming apparatus which includes the process cartridge.

According to an illustrative aspect of the present invention, there is provided a process cartridge that is configured to be detachably installed in an image forming apparatus, comprising: a frame that has an opening that is long in a predetermined direction; a photosensitive drum that is held in the frame, a portion of a surface of the photosensitive drum being opposite to the opening of the frame, the photosensitive drum extending along a longitudinal direction of the opening; and a protection member that has: a linear body portion extending in the longitudinal direction; and a support portion extending from an end of the linear body portion in a direction perpendicular to the longitudinal direction, wherein the support portion is supported on the frame so as to rotate about an axis that extends along the longitudinal direction, and the linear body portion is movable between a protecting position and a retreat position, the protecting position where the liner body portion faces the opening in such a state that the liner body portion is not in contact with the frame, the retreat position where the liner body portion faces a peripheral portion of the opening of the frame.

According to another aspect of the present invention, there is provided an image forming apparatus comprising: a process cartridge; and an installation member into which the process cartridge is installed, wherein the process cartridge comprises: a frame that has an opening that is long in a predetermined direction; a photosensitive drum that is held in the frame, a portion of a surface of the photosensitive drum being opposite to the opening of the frame, the photosensitive drum extending along a longitudinal direction of the opening; a protection member that has: a linear body portion extending in the longitudinal direction; and a support portion extending from an end of the linear body portion in a direction perpendicular to the longitudinal direction, the support portion being supported on the frame so as to rotate about an axis that extends along the longitudinal direction, the linear body portion being movable between a protecting position and a retreat position, the protecting position where the liner body portion faces the opening in such a state that the liner body portion is not in contact with the frame, the retreat position where the liner body portion faces a peripheral portion of the opening of the frame; and a controllable portion that is fixed on the protection member and is operable to move the protection member, wherein the installation member comprises: a controlling portion that is configured to move the protection member from the protecting position to the retreat position by pressing the controllable portion to an upstream side in an installing direction of the process cartridge when the process cartridge is installed into the installation member.

According to another aspect of the present invention, there is provided an image forming apparatus comprising: an apparatus main body; a drawer frame that is removably installed in the apparatus main body; and a process cartridge that is detachably installed in the drawer frame in such a state that the drawer frame is drawn out of the apparatus main body; wherein the process cartridge comprises: a frame that has an opening that is long in a predetermined direction; a photosensitive drum that is held in the frame, a portion of a surface of the photosensitive drum being opposite to the opening of the frame, the photosensitive drum extending along a longitudinal direction of the opening; a protection member that has: a linear body portion extending in the longitudinal direction; and a support portion extending from an end of the linear body portion in a direction perpendicular to the longitudinal direction, the support portion being supported on the frame so as to rotate about an axis that extends along the longitudinal direction, the linear body portion being movable between a protecting position and a retreat position, the protecting position where the liner body portion faces the opening in such a state that the liner body portion is not in contact with the frame, the retreat position where the liner body portion faces a peripheral portion of the opening of the frame; and a controllable portion that is fixed on the protection member and is operable to move the protection member, wherein the apparatus main body comprises: a controlling portion that is configured to move the protection member from the protecting position to the retreat position by pressing the controllable portion to an upstream side in an installing direction of the drawer frame in response to an installing operation of the drawer frame into the apparatus main body.

BRIEF DESCRIPTION OF THE DRAWINGS

Illustrative aspects of the invention will be described in detail with reference to the following figures wherein:

FIG. 4A is a rear view of the process cartridge, FIG. 4B is a right side view of the process cartridge, FIG. 4C is the right side view of the process cartridge and shows sectional views of a lock member and a drum guard, FIG. 4D is a left side view of the process cartridge;

FIG. 5A is a rear view of the process cartridge and shows a state in which the process cartridge is being installed into or removed from a drawer frame, FIG. 5B is a right side view of the process cartridge shown in FIG. 5A, FIG. 5C is the right side view of the process cartridge shown in FIG. 5A and shows sectional views of the lock member and the drum guard, FIG. 5D is a left side view of the process cartridge shown in FIG. 5A;

FIG. 6A is a rear view of the process cartridge and shows a state in which the process cartridge is installed into the drawer frame, FIG. 6B is a right side view of the process cartridge shown in FIG. 6A, FIG. 6C is the right side view of the process cartridge shown in FIG. 6A and shows sectional views of the lock member and the drum guard, FIG. 6D is a left side view of the process cartridge shown in FIG. 6A;

FIG. 8A is a rear view of the process cartridge shown in FIG. 7, which shows a state in which the process cartridge is removed from a drawer case, FIG. 8B is a left side view of the process cartridge shown in FIG. 7, which shows a state in which the process cartridge is removed from the drawer frame;

FIG. 9A is a rear view of the process cartridge shown in FIG. 7, which shows a state in which the process cartridge is installed in the drawer frame, FIG. 9B is a left side view of the process cartridge shown in FIG. 7, which shows a state in which the process cartridge is installed in the drawer frame;

FIG. 11A is a rear view of the process cartridge shown in FIG. 10, which shows a state in which the process cartridge is removed from a drawer frame, FIG. 11B is a left side view of the process cartridge shown in FIG. 7, which shows a state in which the process cartridge is removed from the drawer frame; FIG. 12A is a rear view of the process cartridge shown in FIG. 10, which shows a state of the process cartridge when a drum unit is installed in a body casing, FIG. 12B is a left side view of the process cartridge shown in FIG. 10, which shows a state of the process cartridge when the drum unit is installed in the body casing.

DETAILED DESCRIPTION OF EXEMPLARY EMBODIMENTS OF THE PRESENT INVENTION

Hereinafter, embodiments of the invention will be described in detail by reference to the accompanying drawings.

1. Overall Configuration of Color Printer

Figure 1:
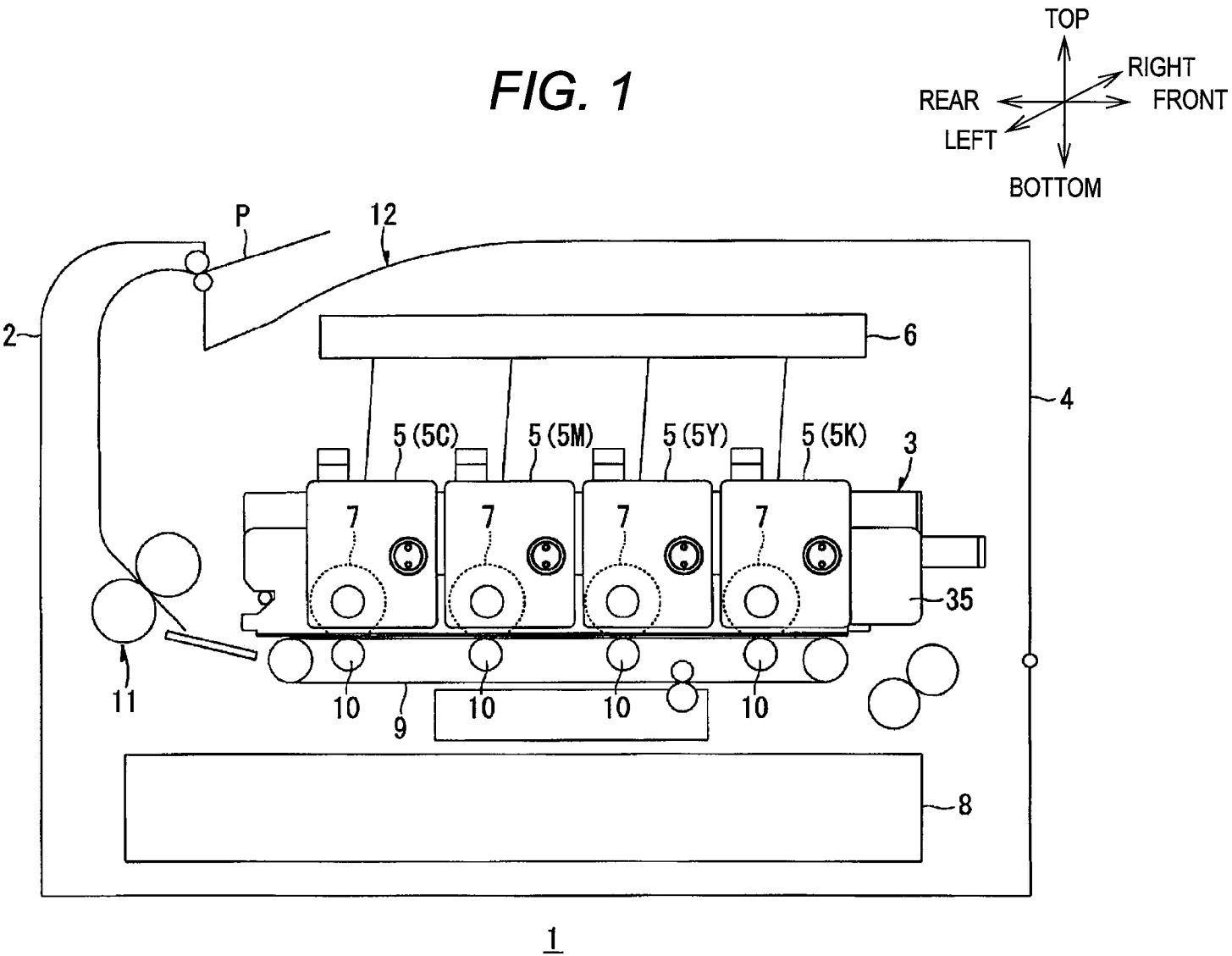
FIG. 1 is a side sectional view of a color printer according to an embodiment of the invention.

FIG. 1 is a side sectional view of a color printer according to an embodiment of the invention.

A color printer 1 as an example of an image forming apparatus is a tandem color printer. A drum unit 3 is installed within a body casing 2 as an example of an apparatus main body. This drum unit 3 is provided so as to be drawn out in a horizontal direction relative to the body casing by opening a front cover 4 which is provided at one side surface of the body casing 2.

In addition, in the following description, a side (a right-hand side in FIG. 1) of the color printer 1 where the front cover 4 is provided is referred to as a front side (a front) and an opposite side (a left-hand side in FIG. 1) is referred to as a rear side (a rear) of the color printer 1. In addition, when discussing about the left and right with respect to the color printer 1, the discussion will be made based on a situation in which the viewer sees the color printer 1 from the front thereof. Hereinbelow, a left-right direction is referred to as a width direction. Also, when discussing about directions as to the drum unit 3, the discussion will be made based on a situation in which the drum unit 3 is installed in the body casing 2, unless otherwise mentioned.

The drum unit 3 includes four process cartridges 5 which are disposed parallel in a front-rear direction and a drawer frame 35 as an example of an installation member which supports the four process cartridges 5 altogether from therebelow. The process cartridges 5 (5K, 5Y, 5M, 5C) are provided so as to correspond to individual colors of black, yellow, magenta and cyan and are arranged side by side at equal intervals sequentially in that order from the front of the drawer frame 35.

The process cartridges 5 can be installed into and removed from the drawer frame 35 from thereabove in such a state that the drum unit 3 is drawn out of an interior of the body casing 2.

By the drum unit 3 being pushed rearwards into the interior of the body casing 2 by opening the front cover 4, the drum unit 3 can be installed into the interior of the body casing 2.

An exposure unit 6 is disposed above the drum unit 3 for emitting four laser beams which correspond individually to the aforesaid four colors. Note that four LED arrays may be provided individually for the respective process cartridges 5 in place of the exposure unit 6.

Each process cartridge 5 includes a photosensitive drum 7. As the photosensitive drum 7 rotates, a surface of the photosensitive drum 7 is charged uniformly by a charger, not shown, and thereafter, the surface so charged is selectively exposed by the laser beam from the exposure unit 6. By this exposure, an electrostatic latent image is formed on the surface of the photosensitive drum 7. Then, as the photosensitive drum 7 rotates, when the electrostatic latent image so formed comes to confront a developing roller, toner is supplied to the electrostatic latent image, whereby a toner image is formed on the surface of the photosensitive drum 7.

A sheet feeding cassette 8 is disposed at a bottom portion of the body casing 2. Sheets P housed in the sheet feeding cassette 8 are transported on to a transport belt 9 by various rollers. The transport belt 9 is disposed so as to face the four photosensitive drums 7 from therebelow. Transfer rollers 10 are disposed individually in positions which lie to face the photosensitive drums 7 via an upper part of the transport belt 9 which is held therebetween. A sheet P that is transported on to the transport belt 9 passes sequentially underneath the individual photosensitive drums 7 as the transport belt 9 runs. Then, the toner images on the photosensitive drums 7 are sequentially transferred on to the sheet P when the photosensitive drums 7 face the sheet P being transported thereunderneath by virtue of transfer bias which is applied by the transfer rollers 10.

A fixing unit 11 is provided downstream of the transport belt 9 with respect to the direction in which the sheet P is transported. The sheet P on which the toner images have been transferred is transported to the fixing unit 11. In the fixing unit 11, the resulting toner image is fixed on to the sheet P by being heated and pressed. Then, the sheet P on to which the toner image has been fixed is discharged on to a sheet discharging tray 12 provided on an upper surface of the body casing 2.

2. Process Cartridges

Figure 2:
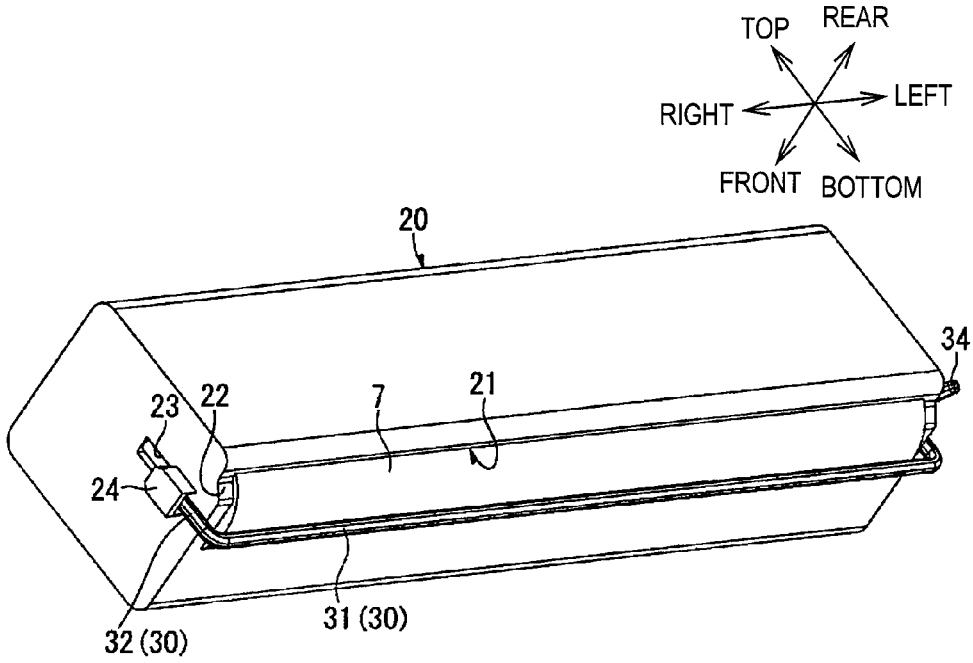
FIG. 2 is a perspective view of the process cartridge when the process cartridge is viewed from a position lying obliquely downwards and rightwards thereof.
Figure 3:
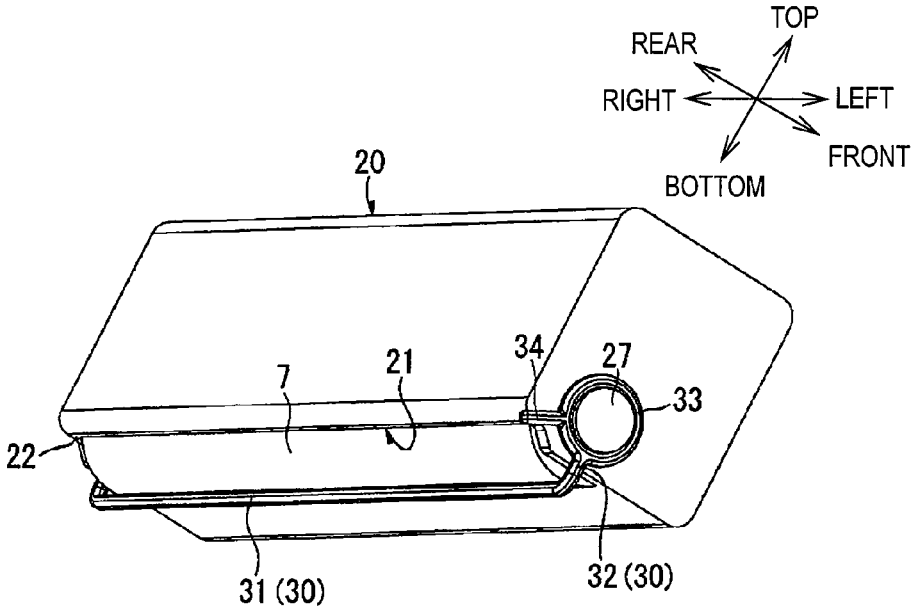
FIG. 3 is a perspective view of the process cartridge when the process cartridge is viewed from a position lying obliquely downwards and leftwards thereof.
Figure 4A:
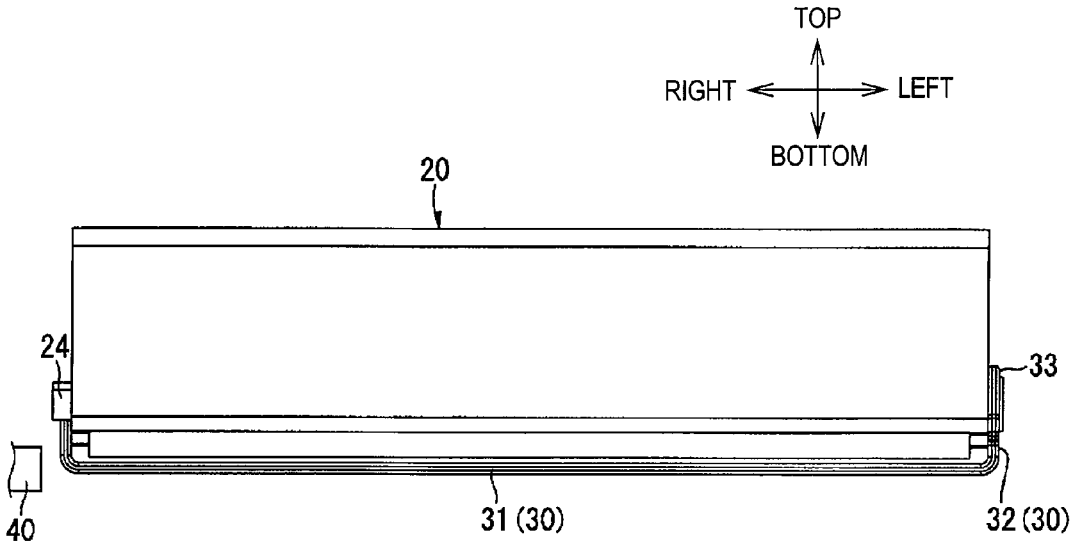
FIGS. 4A to 4D show the process cartridge.
Figure 4B:
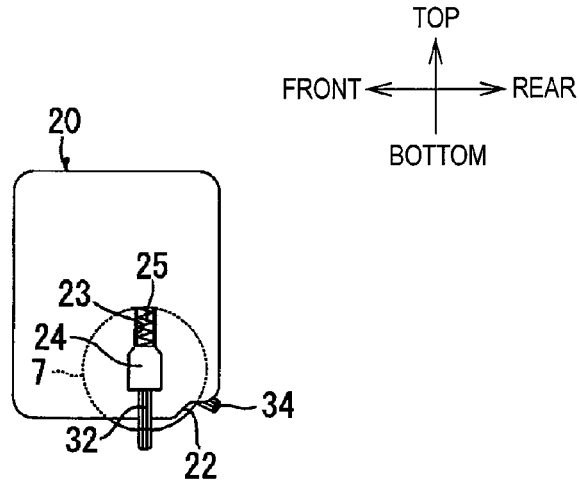
Figure 4C:
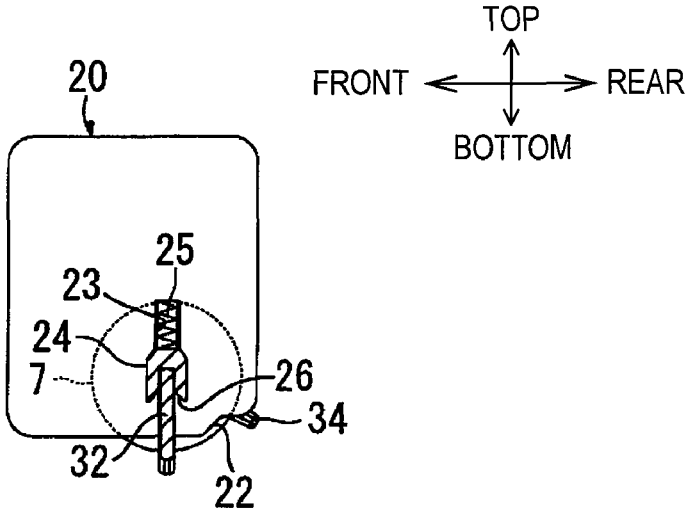
Figure 4D:
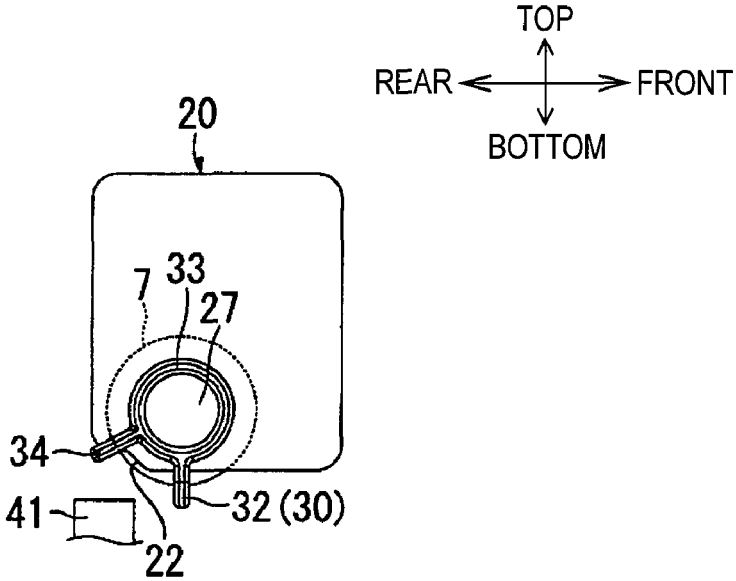

FIG. 2 is a perspective view of the process cartridge resulting when the process cartridge is seen from a position lying obliquely downwards and rightwards thereof. FIG. 3 is a perspective view of the process cartridge resulting when the process cartridge is seen from a position lying obliquely downwards and leftwards thereof. FIG. 4A is a rear view of the process cartridge. FIG. 4B is a right-hand side or end view of the process cartridge. FIG. 4C is the right-hand end view of the process cartridge, and in FIG. 4C, sectional views of a lock member and a drum guard are shown together. FIG. 4D is a left-hand side or end view of the process cartridge.

As shown in FIGS. 2 to 4, the process cartridge 5 includes a substantially rectangular parallelepiped-like frame 20 which is long in the width direction. An opening 21, which is long in the width direction and is made to open downwards, is formed at a rear side portion on a lower surface of the frame 20.

The photosensitive drum 7 and a developing roller, not shown, are disposed within the frame 20, and toner corresponding to one of the four colors is also accommodated therein. The photosensitive drum 7 is made to extend along the width direction and is supported rotatably within the frame 20. Part of a circumferential surface of the photosensitive drum 7 faces the opening 21 and is exposed downwards from the opening 21.

In addition, as shown in FIG. 3, a drive input portion 27 for inputting a driving force into the photosensitive drum 7 is provided on a left-hand side wall of the frame 20 so as to lie on an axis of the photosensitive drum 7. The drive input portion 27 is formed into a circular shape when viewed from the side thereof. As shown in FIG. 1, in such a state that the drum unit 3 is installed in the interior of the body casing 2, a drive transmission mechanism which is provided in the interior of the body casing 2 is connected to the drive input portion 27. A driving force is inputted into the drive input portion 27 from the drive transmission mechanism, and the photosensitive drum 7 is rotated by the driving force so inputted.

(1) Drum Guard

As shown in FIGS. 2 and 3, the process cartridge 5 includes a drum guard 30 as an example of a protection member. The drum guard 30 includes a linear main body portion 31 which extends in the width direction and support portions 32 which extend individually from both ends of the main body portion 31 in a right-angled direction. The main body portion 31 and the support portions 32 are formed by molding a linear metallic material or resin material (a linear member) having a circular cross section in a bent fashion.

For example, in the case of the photosensitive drum 7 having a diameter of 24 mm, the main body portion 31 is formed by the use of a linear member having a diameter of 3 mm. In addition, in the case of the photosensitive drum 7 having a diameter of 30 mm, the main body portion 31 is formed by the use of a linear member having a diameter of 2 mm. Namely, the main body portion 31 of the drum guard 30 is formed by the use of a linear member having a diameter of 1/15 to 1/8 of the diameter of the photosensitive drum 7.

The main body portion 31 is formed so as to extend longer than the frame 20 in the width direction and is disposed in a protecting position where it faces the opening 21 from therebelow in such a state that the process cartridge 5 is removed from the drum unit 3 (refer to FIG. 1) (a state shown in FIGS. 2 to 4D).

As shown in FIG. 4D, a annular ring portion 33 which surrounds the drive input portion 27 is formed at a leading end portion (an end portion which is opposite to an end portion where the support portion 32 connects to the main body portion 31) of the left-hand support portion 32. The ring portion 33 has an inside diameter which is almost the same as an outside diameter of the drive input portion 27 and is supported so as to rotate around the drive input portion 27.

As shown in FIGS. 3 and 4C, a lever 34, as an example of a radially extending controllable portion of the ring portion 33, is provided in a position on the ring portion 33 which lies further rearwards than the connecting portion where the support portion 32 connects to the ring portion 33. By this lever portion 34 being controlled by a controlling portion 41, which will be described later, provided on the drawer frame 35, the drum guard 30 is displaced from the protecting position where the main body portion 31 thereof faces the opening 31 from therebelow to a retreat position where the main body portion 31 is brought into abutment with a portion of the frame which lies on the periphery of the opening 21 therein.

In addition, as shown in FIG. 4C, a leading end portion of the right-hand support portion 32 is disposed on the axis of the photosensitive drum 7 and is supported rotatably in a rotational direction of the photosensitive drum 7 relative to the frame 20. In such a state that the drum guard 30 stays in the protecting position, the right-hand support portion 32 assumes a posture in which the support portion extends substantially perpendicularly.

(2) Lock Member

As shown in FIGS. 2 and 4B, a groove-like sliding portion 23 is formed on the right-hand side wall of the frame 20 so as to extend upwards from a rotational center of the drum guard 30.

A lock member 24, which is formed into a substantially rectangular shape as viewed from the side thereof, is attached to the sliding portion 23. The lock member 24 is provided so as to slidably move in top-bottom or vertical directions relative to the sliding portion 23. As shown in FIG. 4C, the lock member 24 is formed to have a substantially U-shaped cross section which is opened downwards. In addition, an introducing surface 26 which is inclined upwards into an interior of the U-shaped portion in the front-rear direction is formed on each of free ends of this U-shaped portion.

In addition, a spring member 25 adapted to press the lock member 24 downwards is interposed between the lock member 24 and the sliding portion 23.

In such a state that the drum guard 30 stays in the protecting position, that is, in such a state that the right-hand support portion 32 of the drum guard 30 assumes the posture in which the support portion 32 extends substantially perpendicularly, when the lock member receives a pressing force from the spring member 25 and is caused to move downwards, the leading end portion of the right-hand support portion 32 enters the interior of the U-shaped portion (refer to FIG. 4C) of the lock member 24. By this action, the drum guard 30 is fixed in the protecting position.

On the other hand, when the lock member 24 is caused to move upwards against the pressing force from the spring member 25, the right-hand support portion 32 is dislocated from the U-shaped portion inside the lock member 34, whereby the fixation of the drum guard 30 is released.

(3) Frame

A rear wall of the frame 20 has a width which is smaller in the vertical direction than a front wall. In addition, lower end portions of both the side walls or surfaces of the frame 20 are formed so as to project further downwards than a lower end portion of the rear wall and rear-end corner portions thereof are cut out. By this configuration, cut-out portions 22 are formed at the rear-end lower end portions of both the side walls or surfaces of the frame 20.

In such a state that the drum guard 30 stays in the retreat position, arc-like portions which are made by the main body portion 31 and the support portions 32 of the drum guard 30 are accommodated individually in the cut-out portions 22, whereby the main body portion 31 of the drum guard 30 is brought into abutment with the rear wall of the frame from a lower side thereof when the main body portion 31 arrives at the retreat position.

3. Installing and Removing Operations of Process Cartridges

Figure 5A:
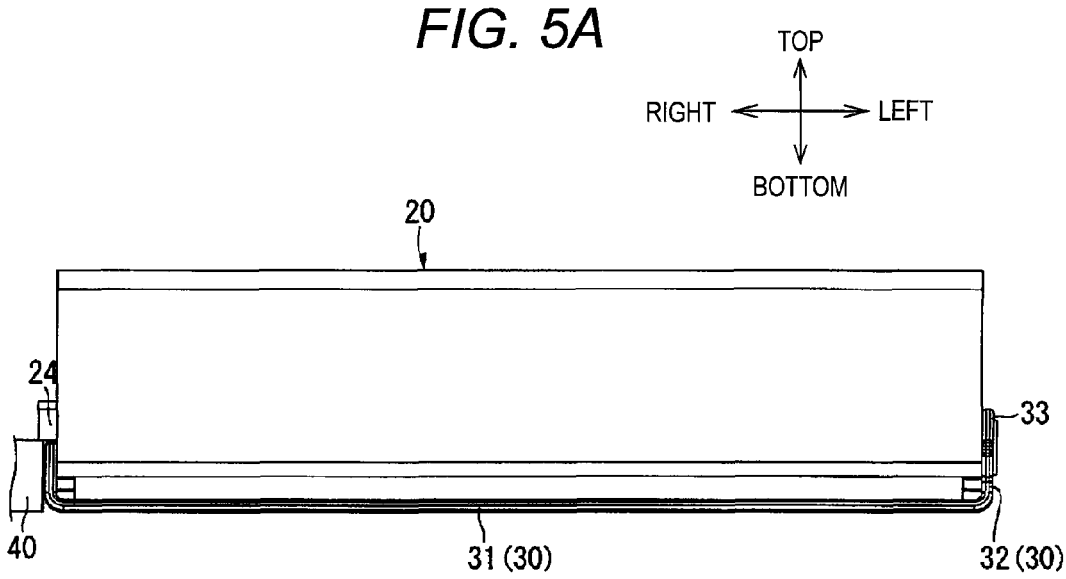
FIGS. 5A to 5D show the process cartridge.
Figure 5B:
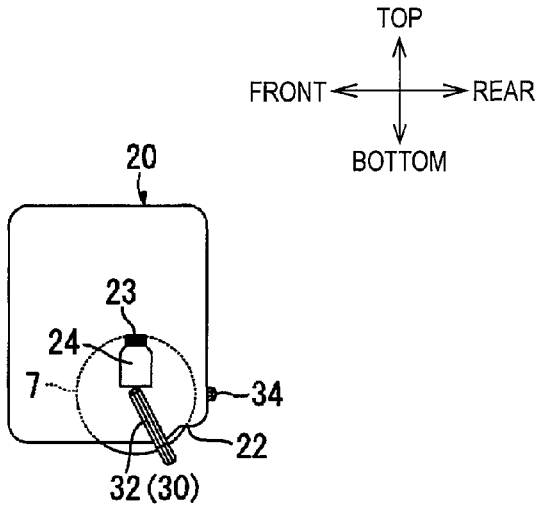
Figure 5C:
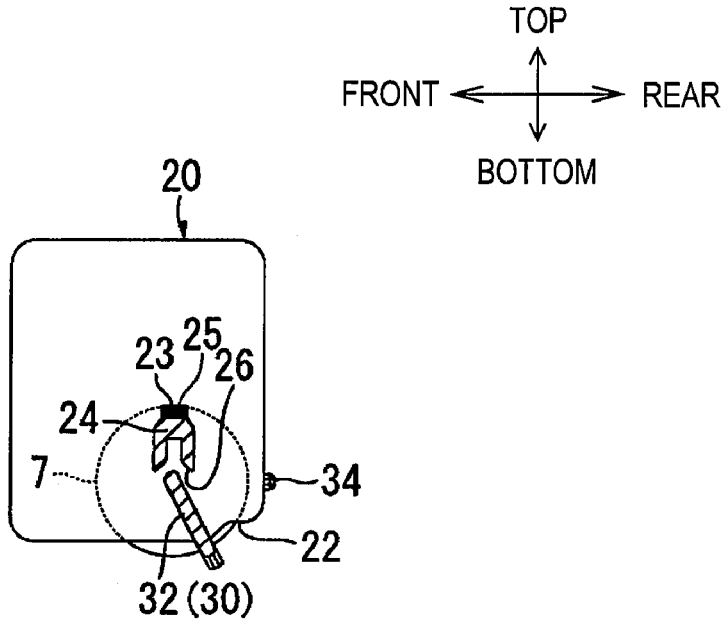
Figure 5D:
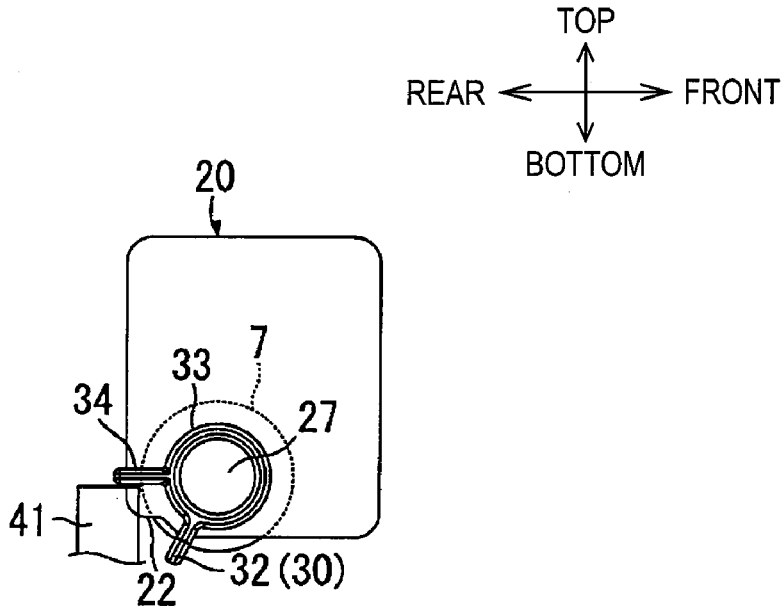
Figure 6A:
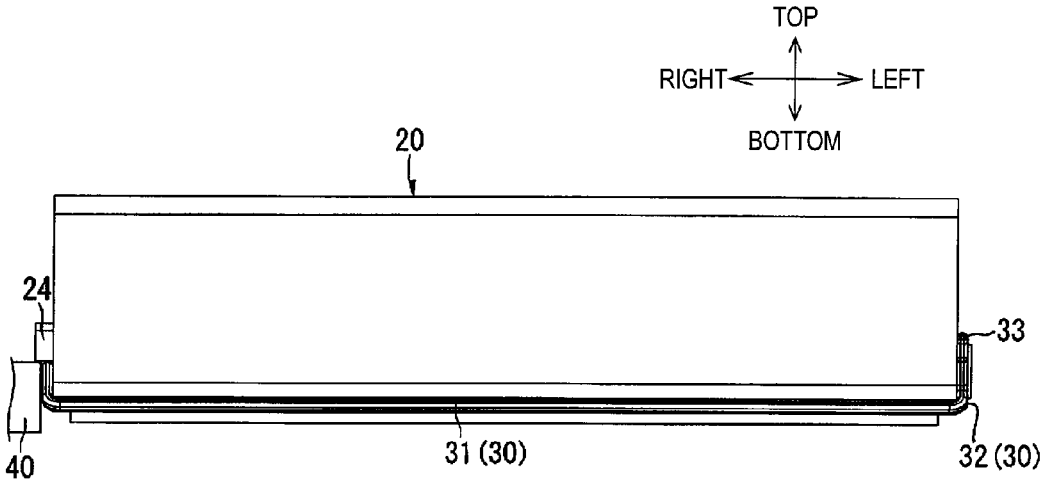
FIGS. 6A to 6D show the process cartridge.
Figure 6B:
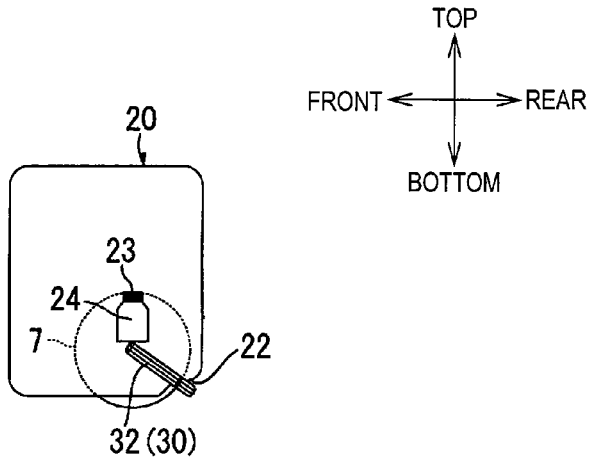
Figure 6C:
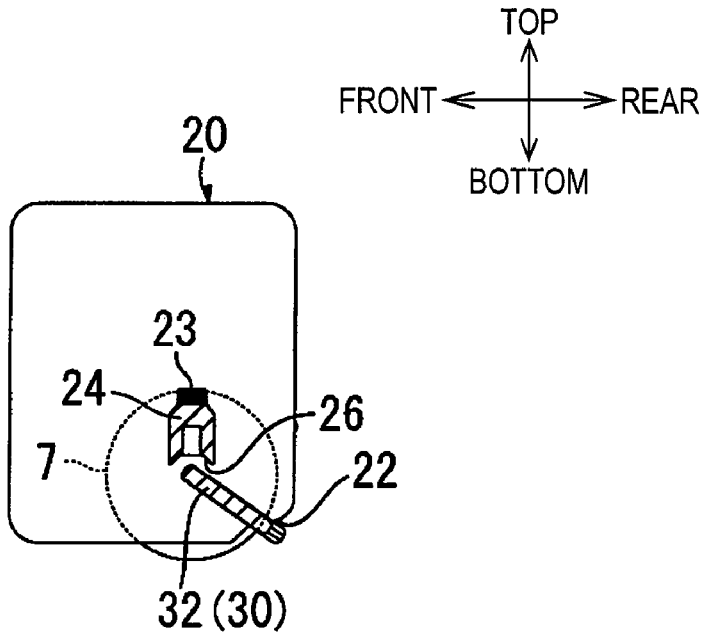
Figure 6D:
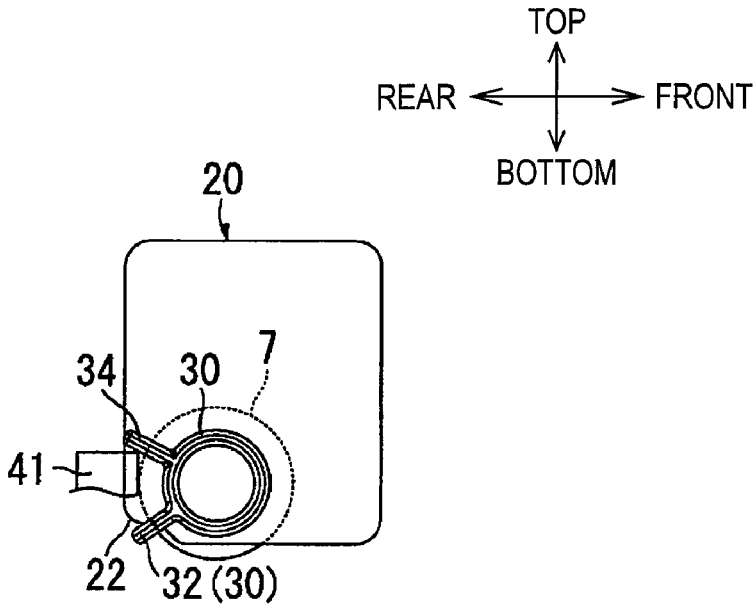

FIG. 5A is a rear view of the process cartridge and shows a state in which the process cartridge is being installed into or removed from the drawer frame. FIG. 5B is a right side view of the process cartridge shown in FIG. 5A. FIG. 5C is the right side view of the process cartridge shown in FIG. 5A, and sectional views of the lock member and the drum guard are also shown in FIG. 5C. FIG. 5D is a left side view of the process cartridge shown in FIG. 5A. FIG. 6A is a rear view of the process cartridge and shows a state in which the process cartridge is installed into the drawer frame. FIG. 6B is a right side view of the process cartridge shown in FIG. 6A. FIG. 6C is the right side view of the process cartridge shown in FIG. 6A, and sectional views of the lock member and the drum guard are also shown in FIG. 6C. FIG. 6D is a left side view of the process cartridge shown in FIG. 6A.

The drawer frame 35 includes release portions 40 and controlling portions 41.

The release portions 40 are formed so as to project inwards in the width direction along an upper end portion of a right-hand side wall of the drawer frame 35, and as shown in FIGS. 4A, 5A, 6A, the release portions 40 are disposed individually in positions where they face vertically the respective lock members 24 of the process cartridges 5.

In addition, the controlling portions 41 are formed so as to project inwards in the width direction along an upper end portion of a left-hand side wall of the drawer frame 35, and as shown in FIGS. 4D, 5D, 6D, the controlling portions 41 are disposed individually in positions where they face vertically the respective levers 34 of the process cartridges 5.

As shown in FIGS. 4A to 4D, in such a state that the process cartridge 5 is removed from the drawer frame 35, the support portions 32 of the drum guard 30 extend in the vertical direction, and the main body portion 31 of the drum guard 30 is disposed in the protecting position where the main body portion 31 faces a portion of the photosensitive drum 7 which is exposed from the opening 21 from therebelow.

In addition, the lock member 24 is pressed downwards by the spring member 25 and is disposed at a lower end portion of the sliding portion 23. In this state, the leading end portion of the right-hand support portion of the drum guard 30 enters the interior of the U-shaped portion (refer to FIG. 4C) of the lock member 24, whereby the drum guard 30 is fixed in the protecting position.

In installing the process cartridge 5 into the drawer frame 35, the process cartridge 5 is caused to move from an upper position above the drawer frame 35 to a lower position therein, and in the course of this lowering operation, the lower end portion of the lock member 24 is brought into abutment with the release portion 40, whereby a further downward movement of the lock member 24 is restricted.

When the process cartridge 5 is caused to move further downwards from this state, the lock member 24 is caused to slidably move upwards relative to the process cartridge 5 along the sliding portion 23 against the pressing force that the lock member 24 receives from the spring member 25, whereby as shown in FIGS. 5A to 5D, the lock member 24 is disposed at an upper end portion of the sliding portion 23. In this state, the leading end portion of the support portion 32 of the drum guard 30 is dislocated from the U-shaped portion (refer to FIG. 5C) of the lock member 24, whereby the fixation of the drum guard 30 is released.

When the process cartridge 5 continues to be lowered further, as shown in FIG. 5D, the lever 34 is brought into abutment with the operating portion 41. Then, as viewed from the left-hand side, the lever 34 is caused to rotate in the clockwise direction in association with the downward movement of the process cartridge. As the lever 34 so rotates, the ring portion 33 is caused to rotate around the drive input portion 27, and due to this rotation of the ring portion 33, the drum guard 30 is caused to rotate in the clockwise direction as viewed from the left-hand side thereof.

As shown in FIGS. 6A to 6D, when the installation of the process cartridge 5 into the drawer frame 35 is completed, the lever is caused to rotate further by the controlling portion 41. In addition, the drum guard 30 is caused to rotate further in the clockwise direction as viewed from the left-hand side, and the arc-like portions which are made up of the main body portion 31 and the support portions 32 are accommodated in the cut-out portions 22 in the frame 20, whereby the main body portion 30 is disposed in the retreat position where the main body portion 30 is brought into abutment with the portion on the frame 20 which lies on the periphery of the opening 21 therein. By this, the main body portion 31 of the drum guard 30 is disposed within the plane of projection of the frame as viewed from the rear and top thereof.

Additionally, an opposite procedure to the procedure that has been described heretofore is taken for removal of the process cartridge 5 from the drawer frame 35. Specifically, firstly, as the process cartridge 5 is caused to move upwards, the main body portion 31 of the drum guar 30 is caused to rotate in a counterclockwise direction as viewed from the left-hand side by gravity. Then, in such a state that the support portions 32 extend substantially perpendicularly, the leading end portion of the right-hand support portion 32 is guided along the introduction surfaces 26 of the lock member 24 so as to face vertically the U-shaped portion of the lock member 24. Thereafter, by the lock member 24 being caused to move downwards as a result of the lock member 24 receiving the pressing force from the spring member 25, the leading end portion of the support portion 32 enters the interior of the U-shaped portion of the lock member 24, and the drum guard 30 is locked in such a state that the drum guard 30 stays in the protecting position.

4. Functions and Advantages

Thus, as has been described heretofore, the process cartridges 5 are installed detachably in the drawer frame 35. The process cartridge 5 includes the frame 20, the photosensitive drum 7 and the drum guard 30. The frame 20 has the opening 21 which is long in the width direction. The photosensitive drum 7 is held in the frame 20, faces the opening 20 at part of the circumferential surface thereof and extends along the width direction of the opening. The drum guard 30 has the linear main body portion 31 which extends in the width direction and the support portions 32 which extend from both the ends of the main body portion 31 in the direction which is at right angles to the width direction. In addition, the drum guard 30 is made to be displaced between the protecting position where the main body portion 31 faces the opening 21 in such a state that the main body portion 31 is not in contact with the frame 20 and the retreat position where the main body portion 31 faces the portions of the frame 20 which lie on the periphery of the opening 21.

Since the main body portion 31*v* of the drum guard 30 is formed into the linear shape, compared with the case where the main body portion 31 of the drum guard 30 is formed into the plate-like shape which covers the photosensitive drum 7, in opening and closing the drum guard 30 (causing the drum guard 30 to move between the protecting position and the retreat position), the space can be reduced through which the main body portion 31 of the drum guard 30 passes. As a result, a space can be reduced which is required within the interior of the color printer 1 for opening and closing the drum guard 30.

In addition, since the drum guard 30 includes the linear main body portion 31 and the support portions 32 which extend from both the ends of the main body portion 31 in the direction which is at right angles to the width direction, the protection of the photosensitive drum 7 can be attained by the simple configuration.

Additionally, the rotational center of the support portion 32 is disposed on the axis of the photosensitive drum 7. By this configuration, the main body portion 31 of the drum guard 30 is made to move along the circumferential direction of the photosensitive drum 7 between the protecting position and the retreat position. Because of this, the space can be reduced further through which the main body portion 31 of the drum guard 30 passes.

In addition, compared with the case where the rotational center of the support portions 32 of the drum guard 30 is not disposed on the axis of the photosensitive drum 7, the rotational radius of the support portions 32 of the drum guard 30 can be reduced. Because of this, in opening and closing the drum guard 30, spaces can be reduced through which the support portions 32 pass. As a result, the space can be reduced further which is required within the interior of the color printer 1 for causing the drum guard 30 to be opened and closed.

Additionally, the lock member 24 is provided on the right-hand side surface of the frame 20 for fixing the drum guard 30 in the protecting position. Because of this, since the drum guard 30 can be fixed in the protecting position, the state can be maintained in which the photosensitive drum 7 is protected by the drum guard 30.

Since the main body portion 31 of the drum guard 30 is made up of the linear member, the protection member can rotate from the protecting position to either of the rotational directions of the protection member. Because of this, by providing the lock member 24 for fixing the drum guard 30 in the protecting position, the drum guard 30 can be fixed in the protecting position, whereby the state in which the photosensitive drum 7 is protected by the drum guard 30 can be maintained in an ensured fashion.

In addition, the lock member 24 fixes the drum guard 30 in the protecting position by holding the support portion 32 from both the sides in the front-rear direction. Because of this, the drum guard 30 can be fixed in the protecting position by the simple configuration.

Additionally, the lock member 24 is provided in such a manner that at least part thereof is situated within the projection plane of the photosensitive drum 7 in the width direction. Because of this, since the release portion 40 for releasing the locking of the drum guard 30 by the lock member 24 is provided within the color printer 1 and the photosensitive drum 7 is disposed downstream as viewed in the installing direction of the process cartridge 5 when the process cartridge 5 is installed, the locking of the drum guard 30 by the lock member 24 can be released by the release portion 40 in the initial stage of the installing operation of the process cartridge 5.

Additionally, the lock member 24 is provided so as to move in the top-bottom or vertical direction (the direction in which the photosensitive drum 7 and the opening 21 face each other). The lock member 24 fixes the drum guard 30 in the protecting position in such a state that the lock member 24 is disposed in the position which lies closest to the opening 21. As this occurs, the end portion of the lock member 24 which lies on the side facing the opening is situated closer to the opening 21 than the axis of the photosensitive drum 7. Because of this, the locking of the drum guard 30 by the lock member 24 can be released in an ensured fashion in an earlier stage after the installing operation of the process cartridge 5 has been started.

In addition, the cut-out portions 22 are formed in the frame 20. The cut-out portions are provided at the portions lying on the periphery of the opening 21, so that the main body portion 31 is accommodated therein when the drum guard 30 is displaced to the retreat position. Consequently, the necessity is obviated of providing a space for accommodating the main body portion 31 when the drum guard 30 is displaced to the retreat position within the color printer 1.

Additionally, the drum guard 30 is formed by bending the linear member having the circular cross section. By adopting this configuration, the drum guard 30 can be obtained by the simple configuration. In addition, since the cross-sectional shape of the drum guard 30 is circular, a corner portion can be prevented from being formed at a boundary portion between the main body portion 31 and the support portions 32, that is, at the bent portions of the linear member.

According to the ninth aspect of the invention, the process cartridge 5 includes the lever 34 which is controlled to displace the drum guard 30. The lever 34 is fixed relative to the drum guard 30. By this configuration, the drum guard 30 can be displaced between the protecting position and the retreat position by controlling the lever 34.

In addition, the drawer frame 35 includes the controlling portions 41. The controlling portion 41 displaces the drum guard 30 from the protecting position to the retreat position by pressing the lever 34 to the upstream side in the installing direction of the process cartridge 5 in association with installation of the process cartridge 5 into the drawer frame 35. By this configuration, the drum guard 30 can be displaced from the protecting position to the retreat position by the installing operation of the process cartridge 5 into the drawer frame 35.

In addition, the drawer frame 35 includes the release portions 40. The release portion 40 releases the fixation of the drum guard 30 by the lock member 24 by pressing the lock member 24 to the upstream side in the installing direction of the process cartridge 5 in association with installation of the process cartridge 5 into the drawer frame 35. By this configuration, when the process cartridge 5 is installed in the drawer frame 35, the fixation of the drum guard by the lock member 24 can be released by the release portion 40.

Additionally, the color printer 1 includes the body casing 2. In addition, the drawer frame 35 is the drawer frame 35 which is provided in the drawable fashion relative to the body casing 2. Because of this, the process cartridges 5 can be installed into and removed from the drawer frame 35 in such a state that the drawer frame 35 is drawn out of the body casing 2.

6. Second Embodiment

Figure 7:
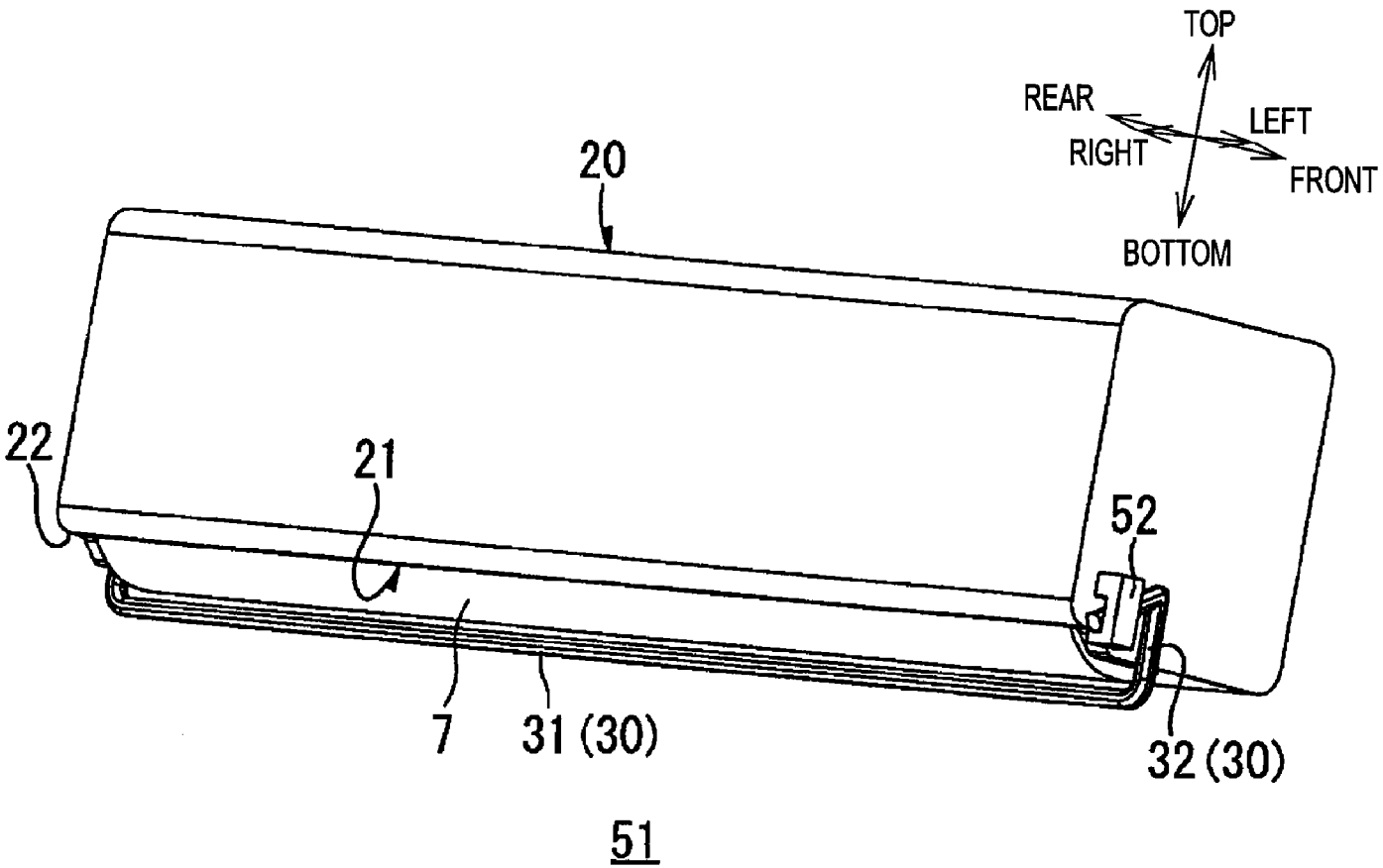
FIG. 7 is a perspective view of a process cartridge according to a second embodiment of the invention when the process cartridge is viewed from a position lying obliquely downwards and leftwards thereof.
Figure 8A:
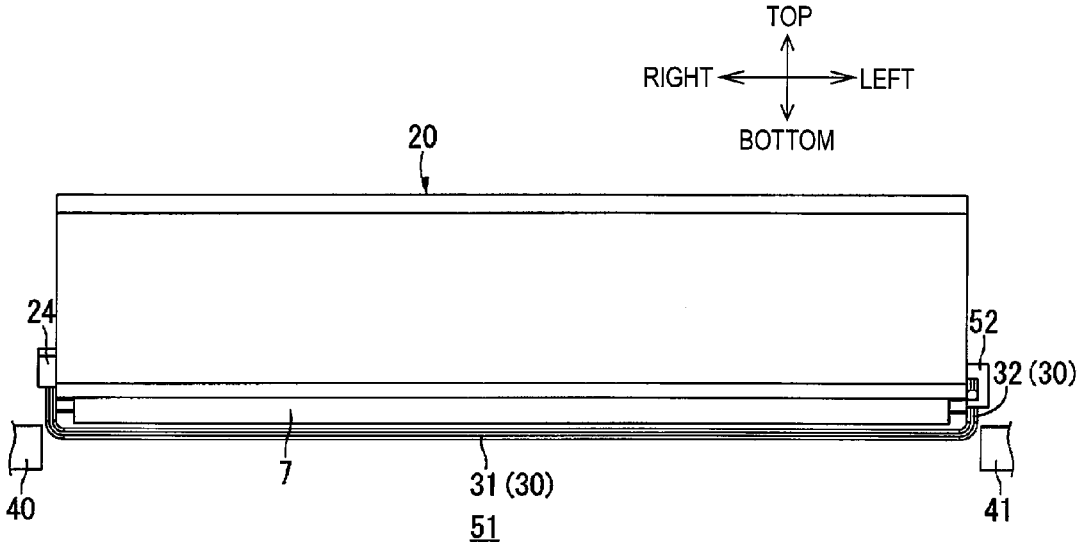
FIGS. 8A to 8B show the process cartridge.
Figure 8B:
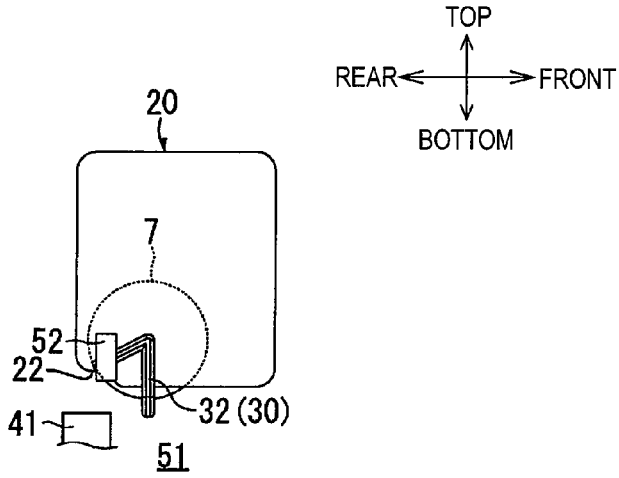
Figure 9A:
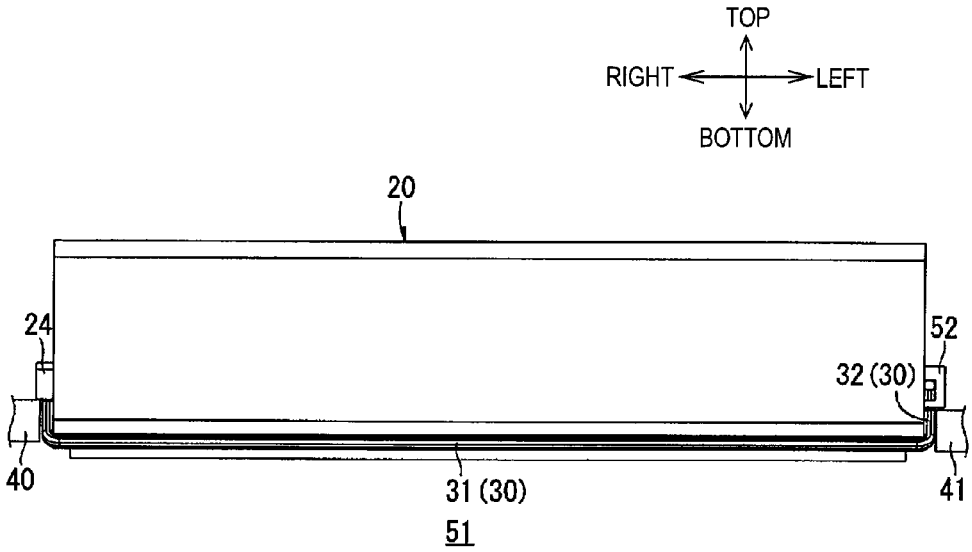
FIGS. 9A to 9B show the process cartridge.
Figure 9B:
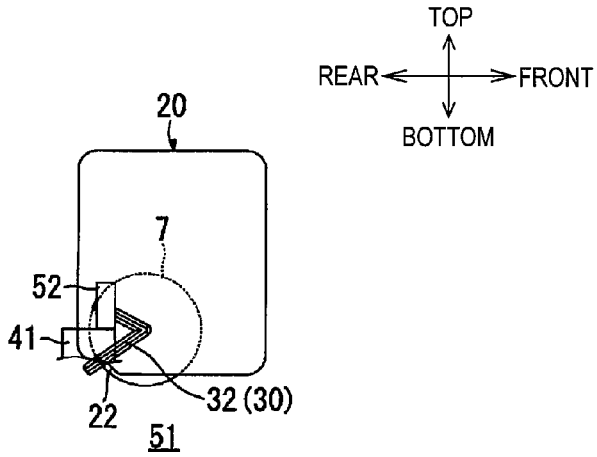

FIG. 7 is a perspective view of a process cartridge according to a second embodiment of the invention which results when the process cartridge is seen from a position lying obliquely downwards and leftwards thereof. FIG. 8A is a rear view of the process cartridge shown in FIG. 7, which shows a state in which the process cartridge is removed from a drawer case. FIG. 8B is a left side view of the process cartridge shown in FIG. 7, which shows a state in which the process cartridge is removed from the drawer frame. FIG. 9A is a rear view of the process cartridge shown in FIG. 7, which shows a state in which the process cartridge is installed in the drawer frame. FIG. 9B is a left side view of the process cartridge shown in FIG. 7, which shows a state in which the process cartridge is installed in the drawer frame.

In addition, hereinbelow, with respect to the configuration of the process cartridge according to the second embodiment shown in FIGS. 7 to 9B, different features from the process cartridge of the first embodiment shown in FIGS. 2 to 6D will mainly be described, and like reference numerals will be given to like portions of the process cartridge of the second embodiment to those of the process cartridge of the first embodiment, so as to omit the description of those like portions.

In the process cartridge 51 shown in FIGS. 7 to 9B, a slider 52 as an example of a controllable portion which can slidably move in a top-down or vertical direction is provided on a left-hand side surface of a frame 20. The slider 52 is formed to have a groove in a rear surface so as to have a substantially U-shaped cross section, and respective free end portions thereof are made to be brought into contact with the frame 20.

In addition, a left-hand support portion 32 is supported on the frame 20 so as to rotate about an axis of a photosensitive drum 7 in a rotational direction of the photosensitive drum 7 in such a state that the process cartridge 51 is installed in a drawer 35. In addition, the left-hand support portion 32 is formed to extend rearwards and downwards further from a rotational center thereof and is supported on the slider 52 in such a state that a leading end portion thereof is inserted between the slider 52 and the left-hand surface of the frame 20.

(1) Installing and Removing Operations of Process Cartridges

In such a state that the process cartridge 51 is removed from the drawer frame 35, as shown in FIGS. 8A and 8B, the support portions 32 of a drum guard 30 extend in the vertical direction, and the drum guard 30 is disposed in a protecting position where a main body portion 31 of the drum guard 30 faces a portion of the photosensitive drum 7 which is exposed from an opening 21 from therebelow.

In addition, a lock member 24 is pressed downwards by a spring member 25 and is disposed at a lower end portion of a sliding portion 23. In this state, a leading end portion of a right-hand support portion 32 of the drum guard 30 enters the inside of a U-shaped portion (refer to FIG. 4C) of the lock member 24, whereby the rotation of the drum guard 30 is locked.

In installing the process cartridge 51 into the drawer frame 35, by the process cartridge 51 being caused to move from an upper position above the drawer frame 35 to a lower position therein, the lock member 24 is caused to move upwards, whereby the fixation of the drum guard 30 by the lock member 24 is released.

Thereafter, when the process cartridge 51 is caused to move further downwards, the slider 52 is brought into abutment with a controlling portion 41. Then, in association with the lower movement of the process cartridge 51, the slider 52 is caused to slidably move upwards. Since the left-hand support portion 32 is provided so as to rotate about the axis of the photosensitive drum 7 and the leading portion thereof is held on to the slider 52, the drum guard 30 is caused to rotate in a clockwise direction as viewed from the left-hand side as the slider 52 slidably moves upwards.

As shown in FIGS. 9A and 9B, when the installation of the process cartridge 51 into the drawer frame 35 is completed, the slider 52 is caused to move upwards by the operating portion 41. In addition, the drum guard 30 is caused to rotate further in the clockwise direction as viewed from the left-hand side, and the main body portion 31 is accommodated in the cut-out portions 22 of the frame 20, whereby the drum guard 30 is disposed in the retreat position where the main body portion 31 is brought into abutment with a portion of the frame 20 which lies on the periphery of the opening 21 therein. By this, the main body portion 31 of the drum guard 30 is disposed within a plane of projection of the frame 20 as viewed from the rear side and the top side thereof.

In addition, an opposite procedure to the procedure that has been described heretofore is taken for removal of the process cartridge 51 from the drawer frame 35. Specifically, firstly, as the process cartridge 51 is caused to move upwards, the main body portion 31 of the drum guar 30 is caused to rotate in a counterclockwise direction as viewed from the left-hand side by gravity. Then, in such a state that the support portions 32 extend substantially perpendicularly, the leading end portion of the right-hand support portion 32 is guided along introduction surfaces 26 of the lock member 24 so as to face vertically the U-shaped portion of the lock member 24. Thereafter, by the lock member 24 being caused to move downwards as a result of the lock member 24 receiving the pressing force from the spring member 25, the leading end portion of the support portion 32 enters the interior of the U-shaped portion of the lock member 24, and the drum guard 30 is locked in such a state that the drum guard 30 stays in the protecting position.

Advantages similar to those provided by the process cartridge 5 shown in FIGS. 2 to 6D can also be provided by the configuration of the process cartridge 51 shown in FIGS. 7 to 9B.

7. Third Embodiment

Figure 10:
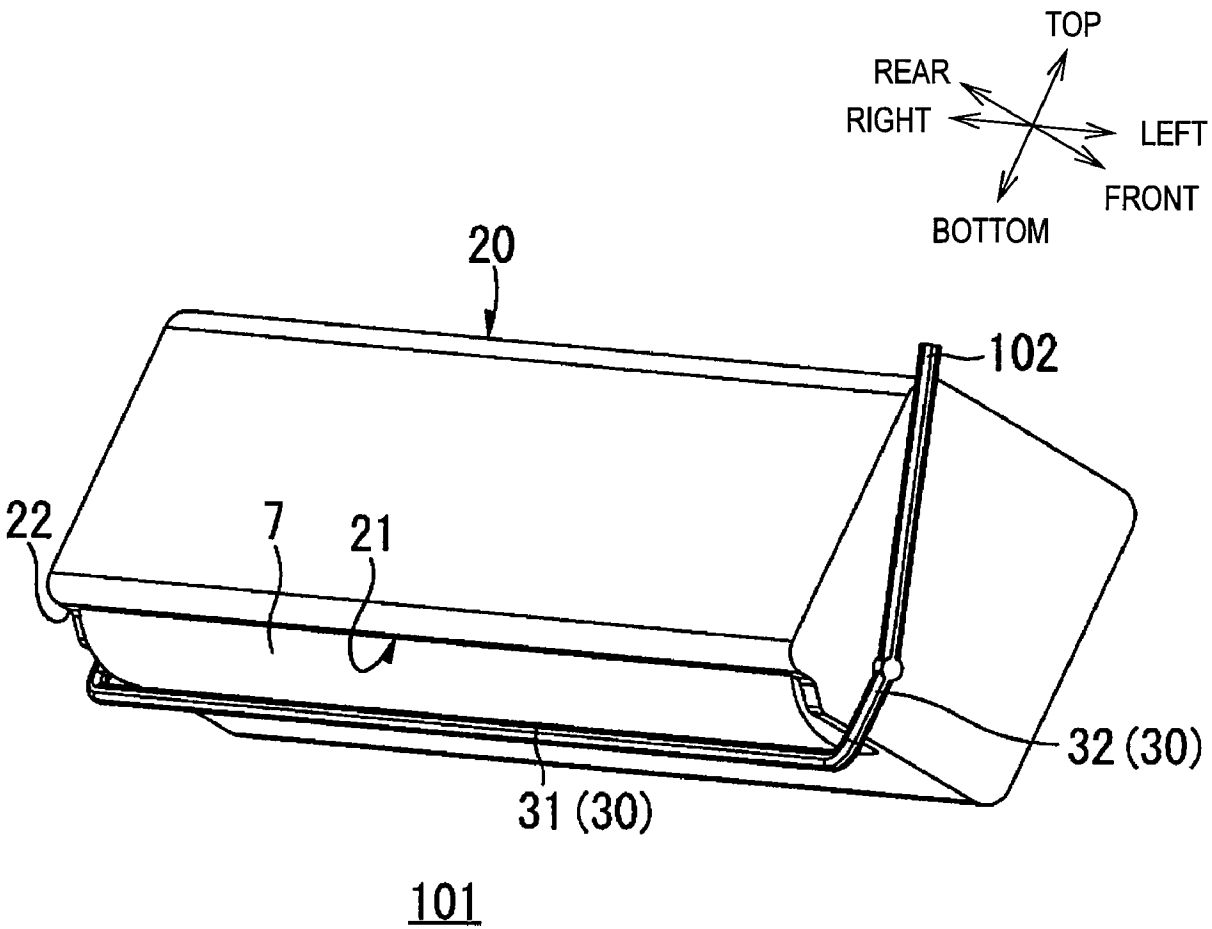
FIG. 10 is a perspective view of a process cartridge according to a third embodiment of the invention when the process cartridge is viewed from a position lying obliquely downwards and leftwards thereof.
Figure 11A:
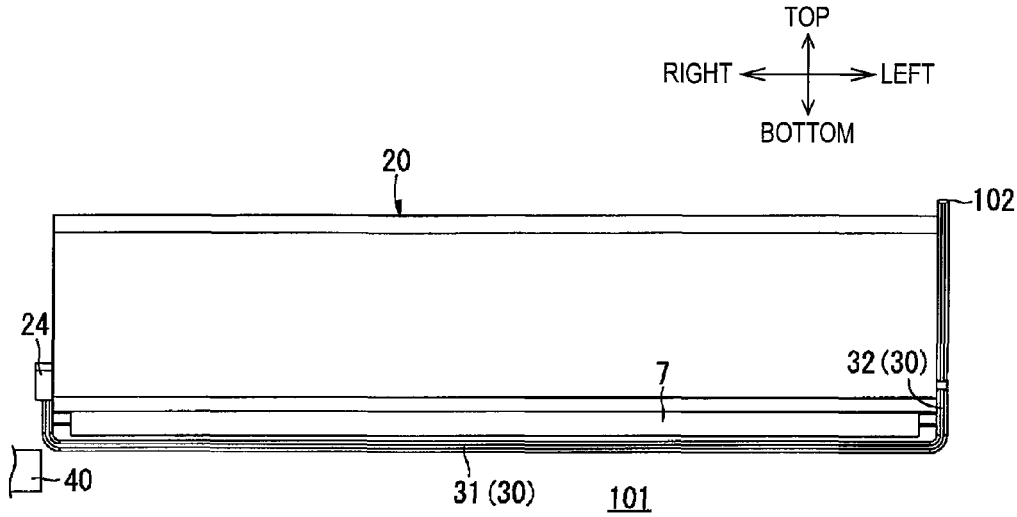
FIGS. 11A to 11B show the process cartridge.
Figure 11B:
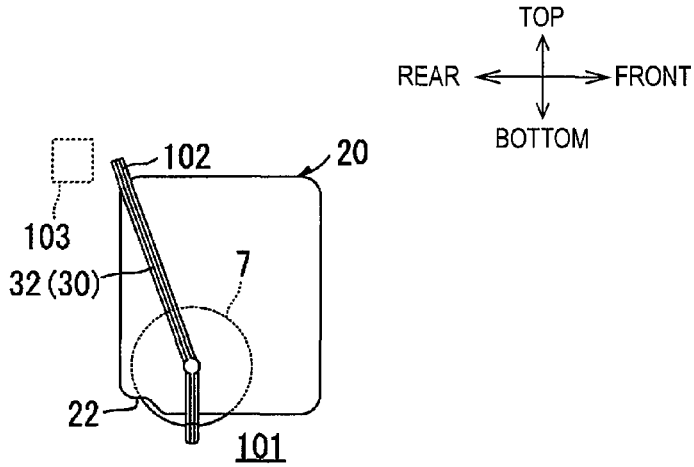
Figure 12A:
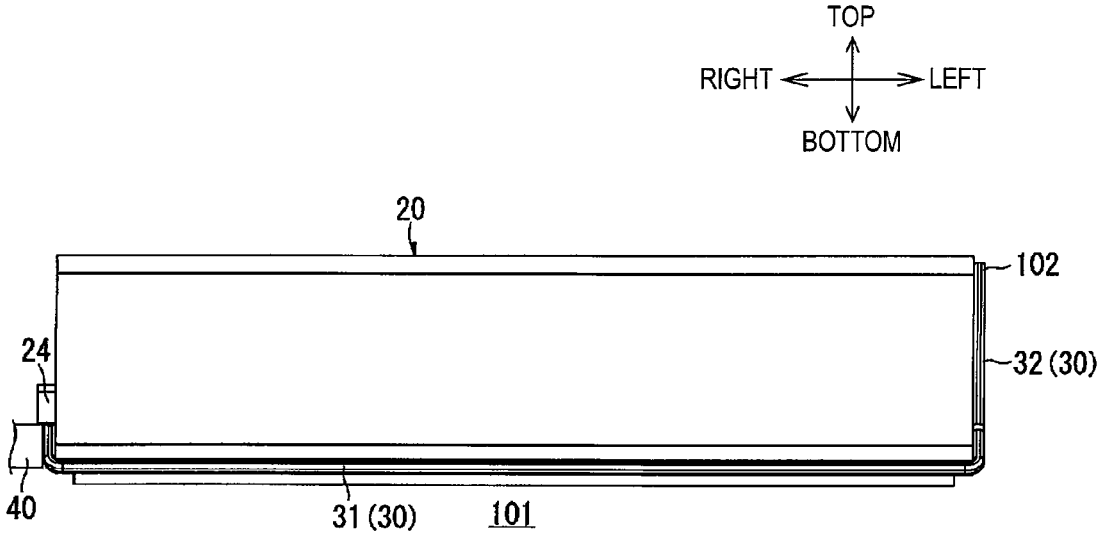
FIGS. 12A to 12B show the process cartridge.
Figure 12B:
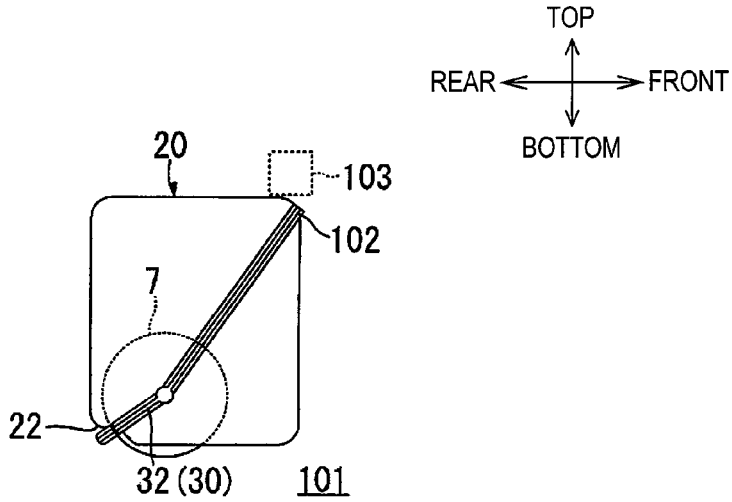

FIG. 10 is a perspective view of a process cartridge according to a third embodiment of the invention which results when the process cartridge is seen from a position lying obliquely downwards and leftwards thereof. FIG. 11A is a rear view of the process cartridge shown in FIG. 10, which shows a state in which the process cartridge is removed from a drawer frame. FIG. 11B is a left side view of the process cartridge shown in FIG. 7, which shows a state in which the process cartridge is removed from the drawer frame. FIG. 12A is a rear view of the process cartridge shown in FIG. 10, which shows a state of the process cartridge when a drum unit is installed in a body casing. FIG. 12B is a left side view of the process cartridge shown in FIG. 10, which shows a state of the process cartridge when the drum unit is installed in the body casing.

In addition, hereinbelow, with respect to the configuration of the process cartridge according to the third embodiment shown in FIGS. 10 to 12B, different features from the process cartridge of the first embodiment shown in FIGS. 2 to 6D will mainly be described, and like reference numerals will be given to like portions of the process cartridge of the third embodiment to those of the process cartridge of the first embodiment, so as to omit the description of those like portions.

In the process cartridge 5 shown in FIGS. 2 to 6D, the configuration is shown in which the main body portion 31 of the drawer guard 30 is displaced between the protecting position and the retreat position as the drawer frame 35 of the process cartridge 5 is installed into and removed from the drawer frame 35.

In contrast to this, in the process cartridge 101 shown in FIGS. 10 to 12B, a main body portion 31 of a drum guard 30 is displaced between a protecting position and a retreat position as a drum unit 3 is installed into and removed from a body casing 2.

A left-hand support portion 32 is supported on a frame 20 so as to rotate about an axis of a photosensitive drum 7 in a rotational direction of the photosensitive drum 7 in such a state that the process cartridge 101 is installed in a drawer 35. In addition, a leading end portion 102 is formed on the left and support portion 32 so as to extend rearwards and upwards further from a rotational center thereof as an example of a controllable portion. A leading end of the leading end portion 102 is made to project further upwards than an upper end portion of the frame 20.

(1) Installing and Removing Operations of Process Cartridges

In such a state that the process cartridge 101 is removed from the drawer frame 35, as shown in FIGS. 11A and 11B, the support portions 32 of a drum guard 30 extend in a top-bottom or vertical direction, and the drum guard 30 is disposed in a protecting position where a main body portion 31 of the drum guard 30 faces a portion of the photosensitive drum 7 which is exposed from an opening 21 from therebelow. In addition, the leading end portion 102 of the left-hand support portion 32 is disposed in front of the frame 20 in such a state that the leading end portion 102 projects further upwards than the upper end portion of the frame 20.

Additionally, a lock member 24 is pressed downwards by a spring member 25 and is disposed at a lower end portion of a sliding portion 23. In this state, a leading end portion of a right-hand support portion 32 of the drum guard 30 enters the inside of a U-shaped portion (refer to FIG. 4C) of the lock member 24, whereby the rotation of the drum guard 30 is locked.

In installing the process cartridge 101 into the drawer frame 35, by the process cartridge 101 being caused to move from an upper position above the drawer frame 35 to a lower position therein, the lock member 24 is caused to move upwards, whereby the fixation of the drum guard 30 by the lock member 24 is released. Thereafter, the process cartridge 101 is caused to move further downwards, whereby the installation of the process cartridge 101 into the drawer frame 35 is completed.

In addition, an opposite procedure to the procedure that has been described heretofore is taken for removal of the process cartridge 101 from the drawer frame 35. Specifically, firstly, as the process cartridge 101 is caused to move upwards, the lock member 24 receives the pressing force from the spring member 25 to thereby be caused to move downwards. By this action, the leading end portion of the support portion 32 enters the inside of the U-shaped portion of the lock member 24, whereby the drum guard 30 is locked in such a state that the drum guard 30 stays in the protecting position.

(2) Installing and Removing Operations of Drum Unit

As is indicated by a broken line in FIGS. 11B and 12B, a controlling portion 103 for controlling the leading end portion 102 of the left-hand support portion 32 is provided within the body casing 2. The controlling portion 103 is provided in a position where the controlling portion 103 does not face the frame 20 in a front-rear direction but faces the leading end portion 102 of the left-hand support portion 32 in the front-rear direction in such a state that the process cartridge 101 is installed in the drawer frame 35.

When the drum unit 3 is pushed in towards the rear, the leading end portion 102 of the support portion 32 is caused to move (rotate) forwards relatively to the process cartridge 101 by the controlling portion 103. Since the left-hand support portion 32 is provided so as to rotate about the axis of the photosensitive drum 7, the drum guard 30 is caused to rotate in a clockwise direction as viewed from the left-hand side in association with the forward movement of the leading end portion 102 thereof. Then, the main body portion 31 of the drum guard 30 is accommodated in cut-out portions 22 of the frame 20, whereby the drum guard 30 is disposed in a retreat position where the main body portion 31 of the drum guard 30 is brought into abutment with a portion of the frame 20 which lies on the periphery of the opening 21 therein. By this, the main body portion 31 of the drum guard 30 is disposed within a plane of projection of the frame 20 as viewed from the rear and top thereof.

Advantages similar to those provided by the process cartridge 5 shown in FIGS. 2 to 6D can also be provided by the configuration of the process cartridge 101 shown in FIGS. 10 to 12B.

According to a first aspect of the present invention, there is provided a process cartridge that is configured to be detachably installed in an image forming apparatus, comprising: a frame that has an opening that is long in a predetermined direction; a photosensitive drum that is held in the frame, a portion of a surface of the photosensitive drum being opposite to the opening of the frame, the photosensitive drum extending along a longitudinal direction of the opening; and a protection member that has: a linear body portion extending in the longitudinal direction; and a support portion extending from an end of the linear body portion in a direction perpendicular to the longitudinal direction, wherein the support portion is supported on the frame so as to rotate about an axis that extends along the longitudinal direction, and the linear body portion is movable between a protecting position and a retreat position, the protecting position where the liner body portion faces the opening in such a state that the liner body portion is not in contact with the frame, the retreat position where the liner body portion faces a peripheral portion of the opening of the frame.

According to a second aspect of the present invention, a rotational center of the support portion is disposed on an axis of the photosensitive drum.

According to a third aspect of the present invention, the process cartridge comprising, a lock member that is configured to fix the protection member in the protecting position, the lock member being provided on one side surface of the frame in the longitudinal direction.

According to a fourth aspect of the present invention, the lock member fixes the protection member in the protecting position by holding both sides of the support portion in a rotational direction of the support portion.

According to a fifth aspect of the present invention, at least a part of the lock member is overlapped with the photosensitive drum as viewed from the longitudinal direction of the photosensitive drum.

According to a sixth aspect of the present invention, the lock member is configured to be movable along a facing direction in which the photosensitive drum and the opening face each other, and when the lock member is disposed in a position that is closest to the opening in the facing direction, the lock member fixes the protection member in the protecting position and an end portion of the lock member which faces the opening is disposed closer to the opening than the rotational center of the support portion.

According to a seventh aspect of the present invention, a cut-out portion is formed on the periphery portion of the opening of the frame, the body portion is accommodated in the cut-portion when the protection member is displaced in the retreat position.

According to an eighth aspect of the present invention, the protection member is formed by bending a linear member that has a circular cross section.

According to a ninth aspect of the present invention, the process cartridge, further comprising, a controllable portion that is fixed on the protection member and is operable to move the protection member.

According to a tenth aspect of the present invention, there is provided an image forming apparatus comprising: a process cartridge; and an installation member into which the process cartridge is installed, wherein the process cartridge comprises: a frame that has an opening that is long in a predetermined direction; a photosensitive drum that is held in the frame, a portion of a surface of the photosensitive drum being opposite to the opening of the frame, the photosensitive drum extending along a longitudinal direction of the opening; a protection member that has: a linear body portion extending in the longitudinal direction; and a support portion extending from an end of the linear body portion in a direction perpendicular to the longitudinal direction, the support portion being supported on the frame so as to rotate about an axis that extends along the longitudinal direction, the linear body portion being movable between a protecting position and a retreat position, the protecting position where the liner body portion faces the opening in such a state that the liner body portion is not in contact with the frame, the retreat position where the liner body portion faces a peripheral portion of the opening of the frame; and a controllable portion that is fixed on the protection member and is operable to move the protection member, wherein the installation member comprises: a controlling portion that is configured to move the protection member from the protecting position to the retreat position by pressing the controllable portion to an upstream side in an installing direction of the process cartridge when the process cartridge is installed into the installation member.

According to an eleventh aspect of the present invention, the process cartridge is installed in the installation member from an opening side thereof, the process cartridge comprise: a lock member that is provided on one side surface of the frame in the longitudinal direction, the lock member configured to be movable along a facing direction in which the photosensitive drum and the opening face each other, the lock member configured to fix the protection member in the protecting position and an end portion of the lock member which faces the opening being disposed closer to the opening than the rotational center of the support portion when the lock member is disposed in a position that is closest to the opening in the facing direction; and wherein the installation member comprises: a release portion that is configured to release a fixation of the protection member by the lock member by pressing the lock member to an upstream side in the installing direction of the process cartridge when the process cartridge is installed into the installation member.

According to an twelfth aspect of the present invention, the image forming apparatus comprising an apparatus main body, and wherein the installation member is a drawer frame that is removably installed in the apparatus main body.

According to a thirteen aspect of the present invention, there is provided an image forming apparatus comprising: an apparatus main body; a drawer frame that is removably installed in the apparatus main body; and a process cartridge that is detachably installed in the drawer frame in such a state that the drawer frame is drawn out of the apparatus main body; wherein the process cartridge comprises: a frame that has an opening that is long in a predetermined direction; a photosensitive drum that is held in the frame, a portion of a surface of the photosensitive drum being opposite to the opening of the frame, the photosensitive drum extending along a longitudinal direction of the opening; a protection member that has: a linear body portion extending in the longitudinal direction; and a support portion extending from an end of the linear body portion in a direction perpendicular to the longitudinal direction, the support portion being supported on the frame so as to rotate about an axis that extends along the longitudinal direction, the linear body portion being movable between a protecting position and a retreat position, the protecting position where the liner body portion faces the opening in such a state that the liner body portion is not in contact with the frame, the retreat position where the liner body portion faces a peripheral portion of the opening of the frame; and a controllable portion that is fixed on the protection member and is operable to move the protection member, wherein the apparatus main body comprises: a controlling portion that is configured to move the protection member from the protecting position to the retreat position by pressing the controllable portion to an upstream side in an installing direction of the drawer frame in response to an installing operation of the drawer frame into the apparatus main body.

According to a fourteenth aspect of the present invention, the process cartridge is installed in the drawer frame from an opening side thereof, the process cartridge comprise: a lock member that is provided on one side surface of the frame in the longitudinal direction, the lock member configured to be movable along a facing direction in which the photosensitive drum and the opening face each other, the lock member configured to fix the protection member in the protecting position and an end portion of the lock member which faces the opening being disposed closer to the opening than the rotational center of the support portion when the lock member is disposed in a position that is closest to the opening in the facing direction; and wherein the drawer frame comprises: a release portion that is configured to release a fixation of the protection member by the lock member by pressing the lock member to an upstream side in the installing direction of the process cartridge when the process cartridge is installed into the drawer frame.

According to the first aspect of the invention, the process cartridge is installed detachably in the image forming apparatus. This process cartridge includes the frame, the photosensitive drum and the protection member. The frame has the opening which is long in the predetermined direction. The photosensitive drum is held in the frame, faces the opening at part of the circumferential surface thereof and extends along the longitudinal direction of the opening. The protection member has the linear main body portion which extends in the longitudinal direction and the support portions which extend from both the ends of the main body portion in the direction which is at right angles to the longitudinal direction. In addition, the protection member is made to be displaced between the protecting position where the main body portion faces the opening in such a state that the main body portion is not in contact with the frame and the retreat position where the main body portion faces the portions of the frame which lie on the periphery of the opening.

Since the main body portion of the protection member is formed into the linear shape, compared with the case where the main body portion of the protection member is formed into the plate-like shape which covers the photosensitive drum, in opening and closing the protection member (causing the protection member to move between the protecting position and the retreat position), the space can be reduced through which the main body portion of the protection member passes. As a result, a space can be reduced which is required within the interior of the image forming apparatus for opening and closing the protection member.

In addition, since the protection member includes the linear main body portion and the support portions which extend from both the ends of the main body portion in the direction which is at right angles to the longitudinal direction, the protection of the photosensitive drum can be attained by the simple configuration.

According to the second aspect of the invention, the rotational center of the support portion is disposed on the axis of the photosensitive drum. By this configuration, the main body portion of the protection member is made to move along the circumferential direction of the photosensitive drum between the protecting position and the retreat position. Because of this, the space can be reduced further through which the main body portion of the protection member passes.

In addition, compared with the case where the rotational center of the support portions of the protection member is not disposed on the axis of the photosensitive drum, the rotational radius of the support portions of the protection member can be reduced. Because of this, when the protection member is opened and closed, spaces can be reduced through which the support portions pass. As a result, the space can be reduced further which is required within the interior of the image forming apparatus for opening and closing the protection member.

According to the third aspect of the invention, the lock member is provided on the one side surface in the longitudinal direction of the frame for fixing the protection member in the protecting position.

In a case where the main body portion of the protection member is made up of a planar member having an arc-like cross section, by the main body portion being brought into contact with the frame of the process cartridge, the protection member can be prevented from rotating from the protecting portion where the main body portion faces the surface of the photosensitive drum to an opposite side to the retreat position. In contrast to this, in the case of the main body portion of the protection member being made up of the linear member, the protection member can rotate from the protecting position to either of the rotational directions of the protection member. Because of this, by providing the lock member for fixing the protection member in the protecting position, the protection member can be fixed in the protecting position, whereby the state in which the photosensitive drum is protected by the protection member can be maintained in an ensured fashion.

According to the fourth aspect of the invention, the lock member fixes the protection member in the protecting position by holding the support portion from both the sides in the rotating direction. Because of this, the protection member can be fixed in the protecting position by the simple configuration.

According to the fifth aspect of the invention, the lock member is provided in such a manner that at least part thereof is situated within the projection plane of the photosensitive drum in the longitudinal direction. By this configuration, a member for releasing the locking of the protection member by the lock member can be provided within the image forming apparatus, and in the event that the photosensitive drum is disposed on the downstream side in the installing direction when the process cartridge is installed, the locking of the protection member by the locking member can be released by the member for releasing the same locking in the initial stage of the installing operation of the process cartridge.

According to the sixth aspect of the invention, the lock member is provided so as to move in the direction in which the photosensitive drum and the opening face each other. The lock member fixes the protection member in the protecting position in such a state that the lock member is disposed in a position which lies closest to the opening. As this occurs, the end portion of the lock member which lies on the side facing the opening is situated closer to the opening than the rotational center of the support portion of the protection member. Because of this, the locking of the protection member by the locking member can be released in an ensured fashion in an earlier stage after the process cartridge installing operation has been started.

According to the seventh aspect of the invention, the cut-out portions are formed in the frame. The cut-out portions are provided at the portions lying on the periphery of the opening, so as to accommodate the main body portion when the protection member is displaced to the retreat position. Consequently, the necessity is obviated of providing a space for accommodating the main body portion when the protection member is displaced to the retreat position within the image forming apparatus.

According to the eighth aspect of the invention, the protection member is formed by bending the linear member having the circular cross section. By adopting this configuration, the protection member can be obtained by the simple configuration. In addition, since the cross-sectional shape of the protection member is circular, a corner portion can be prevented from being formed at a boundary portion between the main body portion and the support portions, that is, at the bent portions of the linear member.

According to the ninth aspect of the invention, the process cartridge includes the controllable portion for displacing the protection member. The controllable portion is fixed relative to the protection member. By this configuration, the protection member can be displaced between the protecting position and the retreat position by controlling the controllable portion.

According to the tenth aspect of the invention, the image forming apparatus includes the process cartridges and the installation member into which the process cartridges are installed. The process cartridges each include the frame, the photosensitive drum, the protection member, and the controllable portion. The frame has the opening which is long in a predetermined direction. The photosensitive drum is held in the frame, is made to face the opening at part of the circumferential surface thereof and extends along the longitudinal direction of the opening. The protection member has the linear main body portion which extends in the longitudinal direction and the support portions which extend from both ends of the main body portion in the direction which is at right angles to the longitudinal direction. In addition, the main body portion is made to be displaced between the protecting position where the main body portion faces the opening in such a state that the main body portion is not in contact with the frame and the retreat position where the main body portion faces portions of the frame which lie on the periphery of the opening. The controllable portion is fixed relative to the protection member and is adapted to be controlled to displace the protection member.

Since the main body portion of the protection member is formed into the linear shape, compares with the case where the main body portion of the protection member is formed into the plate-like shape which covers the photosensitive drum, the space can be reduced through which the main body portion of the protection member passes when the protection member is opened and closed (or is caused to move between the protecting position and the retreat position). As a result, the space can be reduced which is required within the image forming apparatus to allow the protection member to be opened and closed therein.

In addition, since the protection member is made up of the linear main body portion and the support portions which extend from both the ends of the main body portion in the right-angled direction, the protection of the photosensitive drum can be attained by the simple configuration.

In addition, the installation member includes the controlling portions. The controlling portion displaces the protection member from the protecting position to the retreat position by pressing the controllable portion to the upstream side in the installing direction of the process cartridge in association with installation of the process cartridge into the installation member. By this configuration, the protection member can be displaced from the protecting position to the retreat position by the installing operation of the process cartridge into the installation member.

According to the eleventh aspect of the invention, the process cartridges are installed in the installation member from the opening side thereof. In addition, the process cartridges each include the lock member. The lock member is provided on the one side surface in the longitudinal direction of the frame so as to move in the direction in which the photosensitive drum and the opening face each other, so as to fix the protection member in the protecting position in such a state that the lock member is disposed in a position which lies closest to the opening. In this state, the end portion of the lock member lying on the side which faces the opening is situated closer to the opening than the rotational center of the photosensitive drum.

By this configuration, since the protection member can be fixed in the protecting position by the lock member, the state can be maintained in which the photosensitive drum is protected by the protection member. In addition, as this occurs, since the end portion of the lock member lying on the side which faces the opening is situated closer to the opening than the rotational center of the photosensitive drum, the fixing of the protection member in the protecting position by the lock member can be released in an ensured fashion in the early state after the installing operation of the process cartridges has been started.

In addition, the installation member includes the release portions. The release portion releases the fixation of the protection member by the lock member by pressing the lock member to the upstream side in the installing direction of the process cartridge in association with installation of the process cartridge into the installation member. By this configuration, when the process cartridge is installed in the image forming apparatus, the fixation of the protection member by the lock member can be released by the release portion.

According to the twelfth aspect of the invention, the image forming apparatus includes the apparatus main body. In addition, the installation member is the drawer frame which is provided in the drawable fashion relative to the apparatus main body. Because of this, the process cartridges can be installed into and removed from the drawer frame in such a state that the drawer frame is drawn out of the apparatus main body.

According to the thirteenth aspect of the invention, the image forming apparatus includes the apparatus main body, the drawer frame provided in the drawable fashion relative to the apparatus main body, and the process cartridges which are installed in the drawer frame in such a state that the drawer frame is drawn out of the apparatus main body.

The process cartridge includes the frame, the photosensitive drum, the protection member and the controllable portion. The frame has the opening which is long in the predetermined direction. The photosensitive drum is held in the frame, is made to face the opening at part of the circumferential surface thereof and extends along the longitudinal direction of the opening. The protection member has the linear main body portion which extends in the longitudinal direction and the support portions which extend from both the ends of the main body portion in the direction which is at right angles to the longitudinal direction. In addition, the main body portion is made to be displaced between the protecting position where the main body portion faces the opening in such a state that the main body portion is not in contact with the frame and the retreat position where the main body portion faces portions of the frame which lie on the periphery of the opening. The controllable portion is fixed relative to the protection member and is adapted to be controlled to displace the protection member.

Since the main body portion of the protection member is formed linearly, compared with the case where the main body portion of the protection member is formed into the plate-like shape which covers the photosensitive drum, the space can be reduced through which the main body portion of the protection member passes when the protection member is opened and closed (or is made to move between the protecting position and the retreat position). As a result, the space can be reduced which is required within the image forming apparatus to allow the protection member to be opened and closed therein.

In addition, since the protection member includes the linear main body portion and the support portions which extend from both the ends of the main body portion in the right-angled direction, the protection of the photosensitive drum can be attained by the simple configuration.

In addition, the apparatus main body includes the controlling portion. The controlling portion displaces the protection member from the protecting position to the retreat position by pressing the controllable portion to the upstream side in the pushing-in direction of the drawer frame in association with pushing in the drawer frame into the apparatus main body. By this configuration, by the drawer frame being pushed into the apparatus main body, the protection member can be displaced from the protecting position to the retreat position.

According to the fourteenth aspect of the invention, the process cartridges are installed in the drawer frame from the opening side thereof. The lock member is provided on the one side surface in the longitudinal direction of the frame so as to move in the direction in which the photosensitive drum and the opening face each other, so as to fix the protection member in the protecting position in such a state that the lock member is disposed in the position which lies closest to the opening. In this state, the end portion of the lock member which lies on the side which faces the opening is situated closer to the opening than the rotational center of the photosensitive drum.

According to this configuration, since the protection member can be fixed in the protecting position by the lock member, the state can be maintained in which the photosensitive drum is protected by the protection member. In addition, as this occurs, since the end portion of the lock member which lies on the side which faces the opening is situated closer to the opening than the rotational center of the photosensitive drum, the fixation of the protection member by the lock member can be released in an ensured fashion in an early stage after the process cartridge installing operation has been started.

In addition, the drawer frame includes the release portion. The release portion releases the fixation of the protection member by the lock member by pressing the lock member to the upstream side in the installing direction of the process cartridges in association with installing the process cartridges into the drawer frame. By this configuration, when the process cartridges are installed into the drawer frame, the fixation of the protection member by the lock member can be released by the release portion.

What is claimed is:

1. A process cartridge that is configured to be detachably installable in an image forming apparatus, comprising:

a frame having an opening, wherein the opening is long in a predetermined direction;

a photosensitive drum configured to be held in the frame, a portion of a surface of the photosensitive drum being opposite to the opening of the frame, the photosensitive drum extending along a longitudinal direction of the opening;

a protection member including:

a linear body portion extending in the longitudinal direction; and a support portion extending from an end of the linear body portion in a direction perpendicular to the longitudinal direction; and a lock member having a groove portion, wherein the support portion is supported on the frame so as to be rotatable about an axis that extends along the longitudinal direction, wherein the linear body portion is movable between a protecting position and a retreat position, wherein, in the protecting position, the linear body portion faces the opening in such a state that the linear body portion is not in contact with the frame, wherein, in the retreat position, the linear body portion faces a peripheral portion of the opening of the frame, and wherein, when the protection member is in the protecting position, a direction in which the support portion extends is substantially the same as a direction in which the groove portion longitudinally extends.

2. The process cartridge according to claim 1, wherein a rotational center of the support portion is disposed on an axis of the photosensitive drum.

3. The process cartridge according to claim 1, wherein the lock member is provided on one side surface of the frame in the longitudinal direction.

4. The process cartridge according to claim 3, wherein the lock member is configured to fix the protection member in the protecting position by holding both sides of the support portion in a rotational direction of the support portion.

5. The process cartridge according to claim 3, wherein at least a part of the lock member is overlapped with the photosensitive drum as viewed from the longitudinal direction of the photosensitive drum.

6. The process cartridge according to claim 5, wherein:

the lock member is configured to be movable along a facing direction in which the photosensitive drum and the opening face each other, and when the lock member is disposed on the one side surface of the frame in the longitudinal direction in a position closest to the opening in the facing direction, the lock member fixes the protection member in the protecting position and an end portion of the lock member which faces the opening is disposed closer to the opening than a rotational center of the support portion.

7. The process cartridge according to claim 1, wherein a cut-out portion is formed on a periphery portion of the opening of the frame, and wherein the body portion is accommodated in the cut-out portion when the protection member is displaced in the retreat position.

8. The process cartridge according to claim 1, wherein the protection member is formed by bending a linear member that has a circular cross section.

9. The process cartridge according to claim 1, further comprising, a controllable portion that is fixed on the protection member and is operable to move the protection member.

10. An image forming apparatus comprising:

a process cartridge; and an installation member into which the process cartridge is installable, wherein the process cartridge comprises:

a frame having an opening, wherein the opening is long in a predetermined direction;

a photosensitive drum configured to be held in the frame, a portion of a surface of the photosensitive drum being opposite to the opening of the frame, the photosensitive drum extending along a longitudinal direction of the opening;

a protection member including:

a linear body portion extending in the longitudinal direction; and a support portion extending from an end of the linear body portion in a direction perpendicular to the longitudinal direction, wherein the support portion is supported on the frame so as to be rotatable about an axis that extends along the longitudinal direction, the linear body portion being movable between a protecting position and a retreat position, wherein, in the protecting position, the linear body portion faces the opening in such a state that the linear body portion is not in contact with the frame, and wherein, in the retreat position, the linear body portion faces a peripheral portion of the opening of the frame;

a lock member having a groove portion; and a controllable portion fixed on the protection member and operable to move the protection member, wherein the installation member comprises:

a controlling portion configured to move the protection member from the protecting position to the retreat position by pressing the controllable portion to an upstream side in an installing direction of the process cartridge when the process cartridge is installed into the installation member, wherein, when the protection member is in the protecting position, a direction in which the support portion extends is substantially the same as a direction in which the groove portion longitudinally extends.

11. The image forming apparatus according to claim 10, wherein the process cartridge is installed in the installation member from an opening side thereof, wherein the process cartridge comprises:

the lock member, wherein the lock member is provided on one side surface of the frame in the longitudinal direction, the lock member configured to be movable along a facing direction in which the photosensitive drum and the opening face each other, the lock member configured to fix the protection member in the protecting position and an end portion of the lock member which faces the opening being disposed closer to the opening than the rotational center of the support portion when the lock member is disposed in a position closest to the opening in the facing direction, and wherein the installation member comprises:

a release portion configured to release a fixation of the protection member by the lock member by pressing the lock member to an upstream side in the installing direction of the process cartridge when the process cartridge is installed into the installation member.

12. The image forming apparatus according to claim 10, comprising, an apparatus main body, wherein the installation member is a drawer frame that is removably installable in the apparatus main body.

13. An image forming apparatus comprising:

an apparatus main body;

a drawer frame that is removably installable in the apparatus main body; and a process cartridge detachably installable in the drawer frame in such a state that the drawer frame is drawn out of the apparatus main body;

wherein the process cartridge comprises:

a frame having an opening, wherein the opening is long in a predetermined direction;

a photosensitive drum configured to be held in the frame, a portion of a surface of the photosensitive drum being opposite to the opening of the frame, the photosensitive drum extending along a longitudinal direction of the opening;

a protection member including:

a linear body portion extending in the longitudinal direction; and a support portion extending from an end of the linear body portion in a direction perpendicular to the longitudinal direction, wherein the support portion is supported on the frame so as to be rotatable about an axis that extends along the longitudinal direction, the linear body portion being movable between a protecting position and a retreat position, wherein, in the protecting position, the linear body portion faces the opening in such a state that the linear body portion is not in contact with the frame, and wherein, in the retreat position, the linear body portion faces a peripheral portion of the opening of the frame;

a lock member having a groove portion; and a controllable portion fixed on the protection member and operable to move the protection member, wherein the apparatus main body comprises:

a controlling portion that is configured to move the protection member from the protecting position to the retreat position by pressing the controllable portion to an upstream side in an installing direction of the drawer frame in response to an installing operation of the drawer frame into the apparatus main body, and wherein, when the protection member is in the protecting position, a direction in which the support portion extends is substantially the same as a direction in which the groove portion longitudinally extends.

14. The image forming apparatus according to claim 13, wherein the process cartridge is installed in the drawer frame from an opening side thereof, wherein the process cartridge comprises:

the lock member, wherein the lock member is provided on one side surface of the frame in the longitudinal direction, the lock member being configured to be movable along a facing direction in which the photosensitive drum and the opening face each other, the lock member configured to fix the protection member in the protecting position and an end portion of the lock member which faces the opening being disposed closer to the opening than the rotational center of the support portion when the lock member is disposed in a position that is closest to the opening in the facing direction; and wherein the drawer frame comprises:

a release portion configured to release a fixation of the protection member by the lock member by pressing the lock member to an upstream side in the installing direction of the process cartridge when the process cartridge is installed into the drawer frame.

15. A process cartridge that is configured to be detachably installed in an image forming apparatus, the process cartridge comprising:

a frame having an opening, wherein the opening is long in a predetermined direction;

a photosensitive drum configured to be held in the frame, a portion of a circumferential surface of the photosensitive drum facing the opening of the frame in a facing direction, the photosensitive drum extending along a longitudinal direction of the opening; and a protection member including:

a linear body portion extending in the longitudinal direction; and a support portion extending from an end of the linear body portion in a direction perpendicular to the longitudinal direction, wherein the support portion is supported on the frame so as to rotate about an axis that extends along the longitudinal direction, wherein the linear body portion is movable between a protecting position and a retreat position, wherein, in the protecting position, the linear body portion faces the opening in such a state that the linear body portion is not in contact with the frame, wherein, in the retreat position, the linear body portion faces a peripheral portion of the opening of the frame, and wherein, when the linear body portion is at the protecting position, the linear body portion is disposed entirely outside of, in the facing direction, a reference line tangent to a point on a circumference of the photosensitive drum farthest away from the frame.

16. The process cartridge according to claim 15, wherein the linear body portion has a cross section shape in which a length thereof in a circumferential direction of the photosensitive drum is substantially equal to a length thereof in a radial direction of the photosensitive drum.

17. The process cartridge according to claim 15, wherein the linear body portion has a circular cross section.

18. The process cartridge according to claim 15, wherein the protection member is formed by bending a linear member that has a circular cross section.

* * * * *